US010096888B2

(12) United States Patent
Ahn et al.

(10) Patent No.: US 10,096,888 B2
(45) Date of Patent: Oct. 9, 2018

(54) ELECTRONIC DEVICE INCLUDING ANTENNA DEVICE

(71) Applicant: Samsung Electronics Co., Ltd., Suwon-si, Gyeonggi-do (KR)

(72) Inventors: Jung-Ho Ahn, Seoul (KR); Seung-Hwan Kim, Seoul (KR); Ho-Saeng Kim, Anyang-si (KR); Joon-Ho Byun, Seongnam-si (KR)

(73) Assignee: Samsung Electronics Co., Ltd., Suwon-si (KR)

( * ) Notice: Subject to any disclaimer, the term of this patent is extended or adjusted under 35 U.S.C. 154(b) by 184 days.

(21) Appl. No.: 15/153,069

(22) Filed: May 12, 2016

(65) Prior Publication Data

US 2016/0351998 A1 Dec. 1, 2016

(30) Foreign Application Priority Data

May 27, 2015 (KR) ..... 10-2015-0073582

(51) Int. Cl.

| | |
|---|---|
| ***H01Q 1/24*** | (2006.01) |
| ***H01Q 1/42*** | (2006.01) |
| ***H01Q 9/42*** | (2006.01) |
| ***H01Q 5/378*** | (2015.01) |
| ***H01Q 1/48*** | (2006.01) |
| ***H01Q 9/04*** | (2006.01) |

(52) U.S. Cl.

CPC ..... *H01Q 1/243* (2013.01); *H01Q 1/42* (2013.01); *H01Q 1/48* (2013.01); *H01Q 5/378* (2015.01); *H01Q 9/0414* (2013.01); *H01Q 9/42* (2013.01)

(58) Field of Classification Search

CPC ..... H01Q 1/243; H01Q 1/42; H01Q 9/42; H01Q 1/48; H01Q 5/378

See application file for complete search history.

(56) References Cited

U.S. PATENT DOCUMENTS

| | | | | |
|---|---|---|---|---|
| 2002/0084943 | A1 | 7/2002 | Tsai et al. | |
| 2007/0257842 | A1 | 11/2007 | Tseng | |
| 2011/0163937 | A1 | 7/2011 | Jung et al. | |
| 2012/0026064 | A1 | 2/2012 | Lee et al. | |
| 2012/0105287 | A1 | 5/2012 | Jung et al. | |
| 2013/0176178 | A1* | 7/2013 | Chen | H01Q 1/243 343/702 |
| 2014/0125535 | A1 | 5/2014 | Ramachandran et al. | |

(Continued)

*Primary Examiner* — Dieu H Duong

(74) *Attorney, Agent, or Firm* — Jefferson IP Law, LLP

(57) ABSTRACT

An electronic device is provided. The electronic device includes a front cover forming a front surface, a rear cover forming a rear surface, a sidewall at least partially enclosing a space formed between the front cover and the rear cover and at least partially formed of a conductive member, a display disposed in the space and including a screen region exposed through the front cover, a non-conductive structure disposed in adjacent to the sidewall or in contact with the sidewall in the space and including a first surface facing the front cover and a second surface facing the rear cover, a first antenna pattern overlapping the non-conductive structure and fed with electricity, a second antenna pattern overlapping the non-conductive structure and disposed adjacent to the first antenna pattern to form electromagnetic-field coupling with the first antenna pattern, and an integrated circuit chip feeding electricity to the first antenna pattern.

23 Claims, 11 Drawing Sheets

(56) References Cited

U.S. PATENT DOCUMENTS

| | | | |
|---|---|---|---|
| 2014/0184449 | A1 | 7/2014 | Dong et al. |
| 2014/0292590 | A1 | 10/2014 | Yoo et al. |
| 2015/0009074 | A1 | 1/2015 | Hsieh et al. |

* cited by examiner

ELECTRONIC DEVICE INCLUDING ANTENNA DEVICE

CROSS-REFERENCE TO RELATED APPLICATION(S)

This application claims the benefit under 35 U.S.C. § 119(a) of a Korean patent application filed on May 27, 2015 in the Korean Intellectual Property Office and assigned Serial number 10-2015-0073582, the entire disclosure of which is hereby incorporated by reference.

TECHNICAL FIELD

The present disclosure relates to an electronic device. More particularly, the present disclosure relates to an electronic device including an antenna device.

BACKGROUND

Generally, electronic devices refer to devices that perform particular functions according to embedded programs, including home appliances, electronic notes, portable multimedia players (PMPs), mobile communication terminals, tablet personal computers (PCs), video/audio devices, desktop/laptop computers, vehicle navigation systems, and the like. For example, the electronic devices output stored information in the form of audio and video. As the electronic devices have become highly integrated and high-speed and high-volume wireless communication has come into wider use, various functions have been mounted in a single electronic device such as a mobile communication terminal. For example, not only a communication function, but also an entertainment function such as games, a multimedia function such as music/video playback, a communication and security function for mobile banking, a schedule management or electronic wallet function, and so forth have been provided in a single electronic device.

The electronic devices may wirelessly communicate using antenna devices included therein. For example, the electronic device may include various antenna devices such as an antenna device for near field communication (NFC) for wireless charging, an electronic card, and the like, an antenna device for connection with a local area network (LAN), an antenna device for connection with a commercial communication network, and the like. As such, with the development of electronic/information communication technologies, various antenna devices are mounted on a single electronic device, such that the electronic device may select a suitable electronic device according to a use environment or an operation mode to secure an optimal communication environment.

However, in a small-size electronic device such as a mobile communication terminal, it may be difficult to secure a space for disposing an antenna device. Moreover, in the electronic device including a case formed of a metallic material to make an exterior elegant and to guarantee shock resistance, radiation performance of the antenna device is not easy to secure. For example, the metallic case may be an obstacle to wireless communication.

When a case is formed of a metallic material, electricity may be fed to the metallic material portion of the case for use of the metallic material portion of the case as a radiation conductor of the antenna device, thereby securing radiation performance. However, if electricity is directly fed to the metallic material portion of the case, a problem such as electric shock of a user may occur by current leakage and the like.

Moreover, to optimize the antenna device, the length or shape of the radiation conductor may need to be changed, but it may be difficult to change a length or shape in the metallic material portion of the case that forms the exterior of the electronic device. For example, if electricity is fed to the metallic material portion of the case for use of the metallic material portion as the antenna radiation conductor, optimization of the antenna device may not be easy to perform.

The above information is presented as background information only to assist with an understanding of the present disclosure. No determination has been made, and no assertion is made, as to whether any of the above might be applicable as prior art with regard to the present disclosure.

SUMMARY

Aspects of the present disclosure are to address at least the above-mentioned problems and/or disadvantages and to provide at least the advantages described below. Accordingly, an aspect of the present disclosure is to provide an electronic device in which by using a metallic material portion of a case as a radiation conductor while preventing generation of a leakage current, a user electric shock problem may be solved.

Another aspect of the present disclosure is to provide an electronic device in which a metallic material portion of a case is used as a radiation conductor and at the same time, optimization of an antenna device is easy to achieve.

In accordance with an aspect of the present disclosure, an electronic device is provided. The electronic device includes a front cover forming a front surface of the electronic device, a rear cover forming a rear surface of the electronic device, a sidewall at least partially enclosing a space formed between the front cover and the rear cover and at least partially formed of a conductive member, a display disposed in the space and including a screen region exposed through the front cover, a non-conductive structure disposed in adjacent to the sidewall or in contact with the sidewall in the space and including a first surface facing the front cover and a second surface facing the rear cover, a first antenna pattern overlapping the non-conductive structure when viewed from top of the non-conductive structure and fed with electricity, a second antenna pattern overlapping the non-conductive structure when viewed from top of the non-conductive structure and disposed in adjacent to the first antenna pattern to form electromagnetic-field coupling with the first antenna pattern, and at least one integrated circuit (IC) chip feeding electricity to the first antenna pattern, in which the conductive member of the sidewall forms electromagnetic-field coupling with the second antenna pattern, such that the first antenna pattern, the second antenna pattern, and the conductive member form a portion of an antenna device.

Other aspects, advantages, and salient features of the disclosure will become apparent to those skilled in the art from the following detailed description, which, taken in conjunction with the annexed drawings, discloses various embodiments of the present disclosure.

BRIEF DESCRIPTION OF THE DRAWINGS

The above and other aspects, features, and advantages of certain embodiments of the present disclosure will be more apparent from the following description taken in conjunction with the accompanying drawings, in which.

Throughout the drawings, like reference numerals will be understood to refer to like parts, components, and structures.

DETAILED DESCRIPTION

Figure 1:
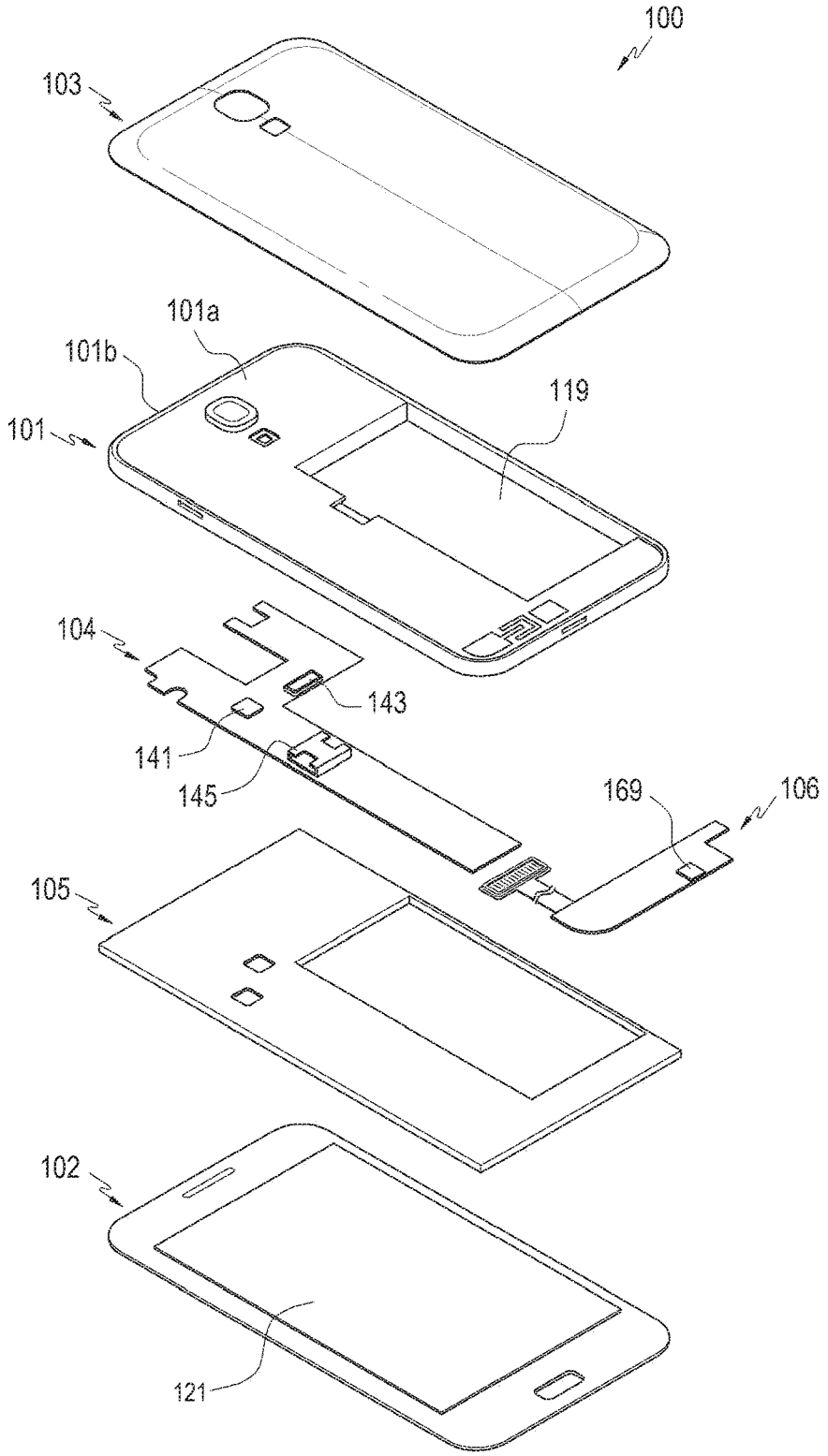
FIG. 1 is an exploded perspective view of an electronic device according to various embodiments of the present disclosure.

The following description with reference to the accompanying drawings is provided to assist in a comprehensive understanding of various embodiments of the present disclosure as defined by the claims and their equivalents. It includes various specific details to assist in that understanding but these are to be regarded as merely exemplary. Accordingly, those of ordinary skill in the art will recognize that various changes and modifications of the various embodiments described herein can be made without departing from the scope and spirit of the present disclosure. In addition, descriptions of well-known functions and constructions may be omitted for clarity and conciseness.

The terms and words used in the following description and claims are not limited to the bibliographical meanings, but, are merely used by the inventor to enable a clear and consistent understanding of the present disclosure. Accordingly, it should be apparent to those skilled in the art that the following description of various embodiments of the present disclosure is provided for illustration purpose only and not for the purpose of limiting the present disclosure as defined by the appended claims and their equivalents.

It is to be understood that the singular forms "a," "an," and "the" include plural referents unless the context clearly dictates otherwise. Thus, for example, reference to "a component surface" includes reference to one or more of such surfaces.

In the present disclosure, an expression such as "A or B," "at least one of A or/and B," or "one or more of A or/and B" may include all possible combinations of together listed items. For example, "A or B," "at least one of A and B," or "one or more of A or B" may indicate the entire of (1) including at least one A, (2) including at least one B, or (3) including both at least one A and at least one B.

Expressions such as "first," "second," "primarily," or "secondary," used in various embodiments may represent various elements regardless of order and/or importance and do not limit corresponding elements. The expressions may be used for distinguishing one element from another element. For example, a first user device and a second user device may represent different user devices regardless of order or importance. For example, a first element may be referred to as a second element without deviating from the scope of the present disclosure, and similarly, a second element may be referred to as a first element.

When it is described that an element (such as a first element) is "operatively or communicatively coupled" to or "connected" to another element (such as a second element), the element can be directly connected to the other element or can be connected to the other element through a third element. However, when it is described that an element (such as a first element) is "directly connected" or "directly coupled" to another element (such as a second element), it means that there is no intermediate element (such as a third element) between the element and the other element.

An expression "configured to (or set)" used in the present disclosure may be replaced with, for example, "suitable for," "having the capacity to," "designed to," "adapted to," "made to," or "capable of" according to a situation. A term "configured to (or set)" does not always mean only "specifically designed to" by hardware. Alternatively, in some situation, an expression "apparatus configured to" may mean that the apparatus "can" operate together with another apparatus or component. For example, a phrase "a processor configured (or set) to perform A, B, and C" may be a generic-purpose processor (such as a central processing unit (CPU) or an application processor (AP)) that can perform a corresponding operation by executing at least one software program stored at an exclusive processor (such as an embedded processor) for performing a corresponding operation or at a memory device.

Terms defined in the present disclosure are used for only describing a specific embodiment and may not have an intention to limit the scope of other various embodiments. When using in a description of the present disclosure and the appended claims, a singular form may include a plurality of forms unless it is explicitly differently represented. In the present disclosure, an expression such as "having," "may have," "comprising," or "may comprise" indicates existence of a corresponding characteristic (such as an element such as a numerical value, function, operation, or component) and does not exclude existence of additional characteristic.

Unless defined otherwise, entire terms including a technical term and a scientific term used here may have the same meaning as a meaning that may be generally understood by a person of common skill in the art. It may be analyzed that generally using terms defined in a dictionary have the same meaning as or a meaning similar to that of a context of related technology and are not analyzed as an ideal or excessively formal meaning unless explicitly defined. In some case, terms defined in the present disclosure cannot be analyzed to exclude the present embodiments.

In various embodiments of the present disclosure, an electronic device may be an arbitrary device having an antenna device and may be referred to as a terminal, a portable terminal, a mobile terminal, a communication terminal, a portable communication terminal, a portable mobile terminal, a display, or the like.

For example, the electronic device may be a smart phone, a cellular phone, a navigation device, a game console, a television (TV), a vehicle head unit, a laptop computer, a tablet computer, a personal media player (PMP), a personal digital assistant (PDA), or the like. The electronic device may be implemented with a pocket-size portable communication terminal having a wireless communication function. The electronic device may be a flexible device or a flexible display.

The electronic device may communicate with an external electronic device such as a server or may work by cooperating with the external electronic device. For example, the electronic device may transmit an image captured by a camera and/or position information detected by a sensor unit to the server over a network. The network may be, but not limited to, a mobile or cellular communication network, a LAN, a wireless local area network (WLAN), a wide area network (WAN), Internet, or a small area network (SAN).

FIG. 1 is an exploded perspective view of an electronic device 100 according to various embodiments of the present disclosure.

Referring to FIG. 1, the electronic device 100 may include a case 101, a front cover 102, and a rear cover 103, and at least a portion of the case 101 may form a radiation conductor of an antenna device. The electronic device 100 may include conductive patterns, for example, a first antenna pattern 111*a* and a second antenna pattern 111*b*, which will be described later. The conductive patterns may form electromagnetic-field coupling with a portion of the case 101 forming a portion of the radiation conductor.

The case 101 has an open front surface and may include a non-conductive structure (e.g., a case member 101*a*) and a sidewall (e.g., a frame 101*b*).

The non-conductive structure, for example, the case member 101*a* is disposed between the front cover 102 and the rear cover 103, includes a first surface facing the front cover 102 and a second surface facing the rear cover 103, and at least partially closes a rear surface of the case 101. The sidewall, for example, the frame 101*b* is disposed to at least partially enclose a space formed between the front cover 102 and the rear cover 103. For example, the frame 101*b* may form an internal space of the case 101 by forming the sidewall on the first surface of the case member 101*a* along a circumference.

The case 101 may be at least partially formed of a metallic material. Another portion of the case 101 may be formed of synthetic resin. For example, the case member 101*a* may include synthetic resin and the entire frame 101*b* or a portion thereof may include a metallic material. If the case 101 is formed of a combination of a metallic material and a synthetic resin material, the case 101 may be molded by insert injection. For example, the case member 101*a* is molded by injecting melted synthetic resin into a mold when the frame 101*b* formed of a metallic material is placed on the mold, such that the frame 101*b* is coupled to the case member 101*a* simultaneously with molding of the case member 101*a*, thus forming the case 101. The metallic material portion of the frame 101*b* may form a portion of the antenna device of the electronic device 100. The structure of the antenna device will be described in more detail with reference to FIG. 2.

The front cover 102 may include a window member coupled with a display 121. For example, the display 121 may include a screen area exposed through the front cover 102, and the screen area of the display 121 may be exposed outside through the window member. According to various embodiments, a touch panel may be integrated in the front cover 102 to provide a function of an input device.

The electronic device 100 may include at least one circuit boards 104 and 106 received in the case 101. For example, the circuit boards 104 and 106 on which electronic parts such as an integrated circuit (IC) chip 141 like an AP, a communication module, a memory, an audio module, a power management module, or the like, various sensors and connectors 143, a storage medium socket 145, and a connector 169 for connection with some components of the antenna device or an external device may be received in the case 101. Such various electronic parts may be distributed on the first circuit board 104 and the second circuit board 106. For example, the IC chip 141 may be disposed on the first circuit board 104 and the connector 169 for connection with some components of the antenna device or an external device may be disposed on the second circuit board 106. The IC chip 141 may include at least one of an AP, a communication module, and an audio module.

The first circuit board 104 and the second circuit board 106 may be manufactured to correspond to the shape of a space provided by the case 101. For example, the case 101 may provide a mounting groove 119 for receiving a battery, and the first circuit board 104 and the second circuit board 106 may have a shape suitable for being disposed on a circumference of the mounting groove 119 inside the case 101.

The electronic device 100 may include a support member 105 received in the case 101. The support member 105 improves mechanical rigidity of the electronic device 100 and protects and separates internal electronic parts from each other. For example, various electronic parts such as the IC chip 141 are mounted on the first circuit board 104 and the second circuit board 106, such that a direct contact of the first circuit board 104 and the second circuit board 106 with the front cover 102 may damage the display 121. The support member 105 is disposed between the first and second circuit board 104 and 106 and the display 121 to prevent the electronic parts from directly contacting the display 121.

The support member 105 shields electromagnetic waves generated by operations of the electronic parts to prevent the electromagnetic waves from affecting operations of other electronic parts. For example, since the support member 105 is disposed, the display 121 may operate stably without being affected by the electromagnetic waves generated by other electronic parts. The support member 105 provides various structures allowing mounting and fixing of the first circuit board 104 and the second circuit board 106, and supports the front cover 102 to stably maintain a flat panel shape.

The rear cover 103 (e.g., a cover member) may be removably provided on the rear surface of the case 101. When the cover member 103 is separated, the mounting groove 119 is open to allow a user to replace a battery with another one. Among the electronic parts, the storage medium socket 145 may be exposed to the rear surface of the case 101, and the cover member 103 is mounted on the rear surface of the case 101 to separate and protect the mounting groove 119 or the storage medium socket 145 from an external environment.

Figure 2:
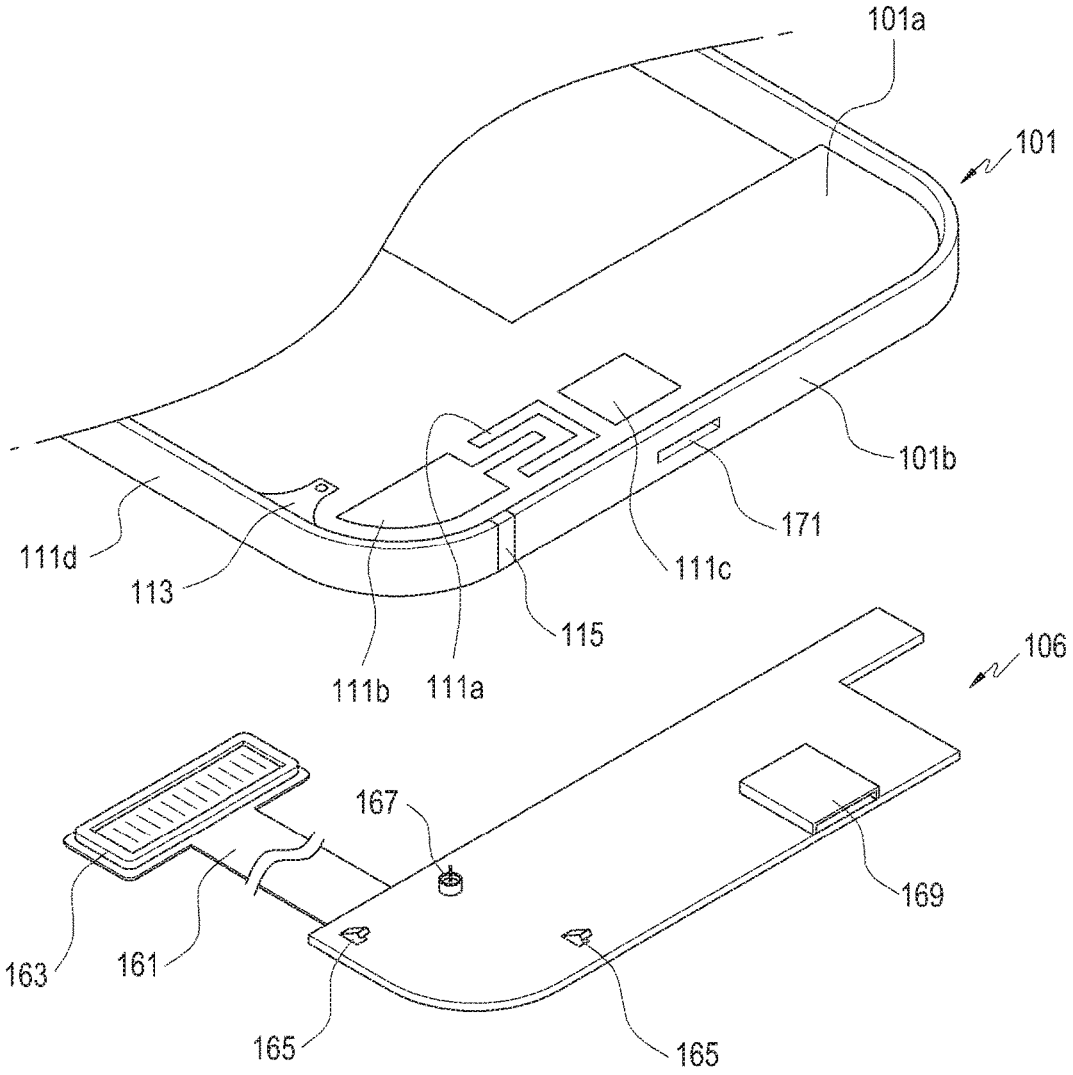
FIG. 2 is an exploded perspective view of an antenna device of an electronic device according to various embodiments of the present disclosure.

FIG. 2 is an exploded perspective view of an antenna device of an electronic device according to various embodiments of the present disclosure.

The antenna device of the electronic device 100 may be connected with a communication module provided in the form of an IC chip or as a combination of IC chips to provide a wireless transmission and reception function. The antenna device may use at least a partial metallic material (e.g., a portion of the frame 101*b*) of the electronic device 100 exposed to outside as a radiation conductor.

Referring to FIG. 2, the frame 101*b* of the case 101 is formed of a conductive metallic material, and may include at least one dividing portion 115 from which a portion of the metallic material is removed. If the electronic device 100 includes a connector 169 (e.g., an interface connector) for connection with another electronic device (e.g., a charging device or the like), the frame 101*b* may include an opening 171 to provide a connection path to the connector 169.

The case member 101*a* is formed of a synthetic resin material, and the frame 101*b* is formed of a metallic material. When the frame 101*b* is formed integrally with the case member 101*a* through a process such as insert injection, the frame 101*b* may include at least one binding piece(s) 113 to reinforce binding between a metallic material portion and a synthetic resin material portion. For example, the binding piece 113 may protrude from an inner side of the frame 101*b* and may be positioned in the case member 101*a*. The shape of the binding piece 113 secures a larger contact area between the metallic material portion and the synthetic resin material portion than a structure having no binding piece, thereby reinforcing binding between the metallic material portion and the synthetic resin material portion. The binding piece 113 may be used as a connection piece for electrically connecting a portion of the frame 101*b* to the second circuit board 106. For example, the binding piece 113 may be electrically connected to the second circuit board 106.

A portion of the frame 101*b*, for example, an edge portion in which two different sides of the electronic device 100 are connected may be formed of a metallic material, for example, a conductive member 111*d*, for use as the radiation conductor of the antenna device. According to various embodiments, all sides of the electronic device 100, for example, the entire frame 101*b* may be made of a metallic material. However, if a portion of the frame 101*b* needs to be used to construct the antenna device suitable for the electronic device 100, the dividing portion 115 may be formed in a plurality of proper positions to implement the conductive member 111*d*. On an inner side of the conductive member 111*d* is formed at least one binding piece 113.

The electronic device 100 may include the first antenna pattern 111*a* and the second antenna pattern 111*b* formed on an outer surface of the caser member 101*a*, for example, the aforementioned second surface. When viewed from top of the case member 101*a*, the first antenna pattern 111*a* and the second antenna pattern 111*b* are disposed to overlap the case member 101*a* and are disposed in adjacent to each other. The first antenna pattern 111*a* is fed with electricity through the second circuit board 106, and the second antenna pattern 111*b* forms electromagnetic-field coupling with the first antenna pattern 111*a* fed with electricity, thus being used as a portion of the antenna device, for example, a radiation conductor. The second antenna pattern 111*b* is disposed in adjacent to the conductive member 111*d* to form electromagnetic-field coupling with the conductive member 111*d*.

To feed electricity to the first antenna pattern 111*a*, a connection terminal 165 such as a flexible conductive connector, for example, a C-clip, may be disposed on the second circuit board 106. For example, the connection terminal 165 may be electrically connected directly to the first antenna pattern 111*a* to send a feed signal to the first antenna pattern 111*a*. As mentioned above, if the binding piece 113 is used as a connection portion, another connection terminal 165 may be disposed on the second circuit board 106. The connection terminal 165 connected with the binding piece 113 may be connected to a ground portion G provided on the second circuit board 106 or the first circuit board 104. The connection terminal(s) 165 may include the same metallic material as the conductive member.

A structure in which the connection terminals 165 are electrically connected to and contact the first antenna pattern 111*a* and the binding piece 113 will be described in more detail with reference to FIG. 6.

The second circuit board 106 provides electric connection to the first antenna pattern 111*a* or the conductive member 111*d*. For example, the second circuit board 102 may connect to the first circuit board 104 through a connector 163 by including a flexible printed circuit board or a ribbon cable 161 for connection to the first circuit board 104 and another connector 163 provided on an end portion thereof. Thus, the first antenna pattern 111*a* may receive a feed signal from a communication module disposed on the first circuit board 104, for example, the IC chip 141. The IC chip 141 provides a radio signal having a frequency in a range selected from a frequency band from 0.7 GHz to 3 GHz. For example, the frequency of the radio signal provided by the IC chip 141 may include a frequency band of 2.1 GHz to 3 GHz. According to various embodiments, a coaxial connector 167 may be provided on the second circuit board 106, and if a communication module is disposed on the first circuit board 104, a radio transmission and reception signal (e.g., a feed signal provided to the first antenna pattern 111*a*) may be delivered between the first circuit board 104 and the second circuit board 106 through the coaxial connector 167.

According to various embodiments, the electronic device 100 may further include a parasitic antenna pattern 111*c* formed on the case member 101*a*. The parasitic antenna pattern 111*c* may be disposed to be stacked with conductive parts disposed in the electronic device 100, for example, the connector 169. The antenna device of the electronic device 100 according to various embodiments may form a resonant frequency in a plurality of different frequency bands, and by forming the parasitic antenna pattern 111*c*, a bandwidth of a resonant frequency formed in a high frequency band may be adjusted or used for impedance matching.

Figure 3:
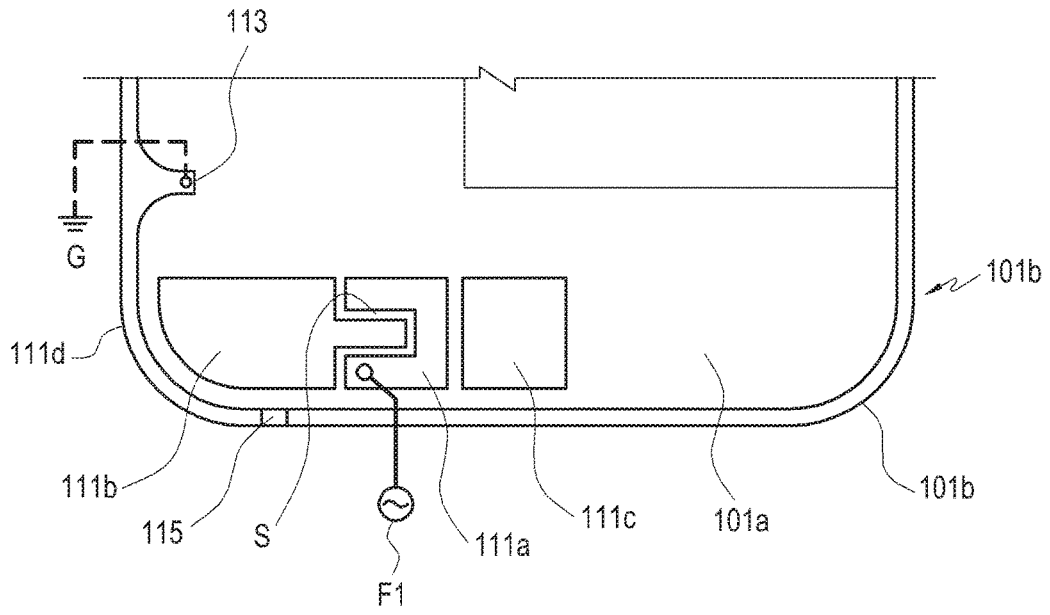
FIG. 3 is a view illustrating a structure of an antenna device of an electronic device according to various embodiments of the present disclosure.

FIG. 3 is a view illustrating a structure of an antenna device of an electronic device according to various embodiments of the present disclosure.

Figure 4:
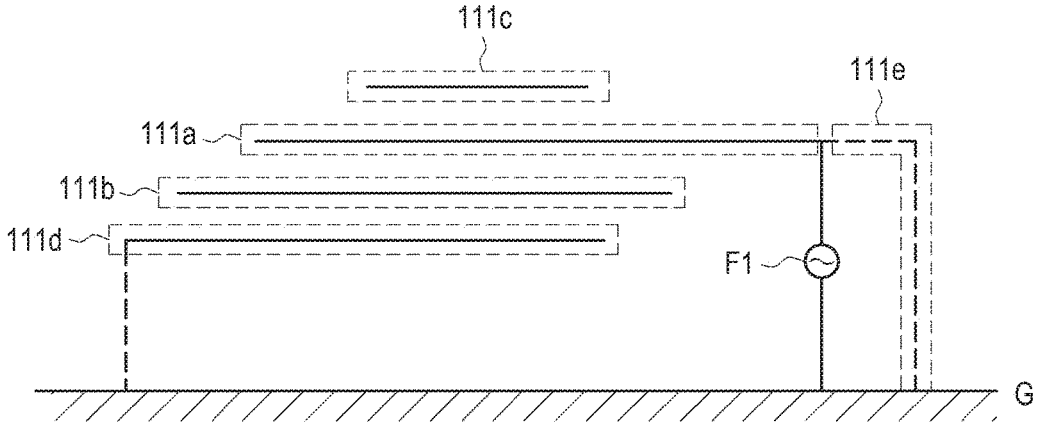
FIG. 4 is a circuit diagram of an antenna device of an electronic device according to various embodiments of the present disclosure.

FIG. 4 is a circuit diagram of an antenna device of an electronic device 100 according to various embodiments of the present disclosure.

Figure 5:
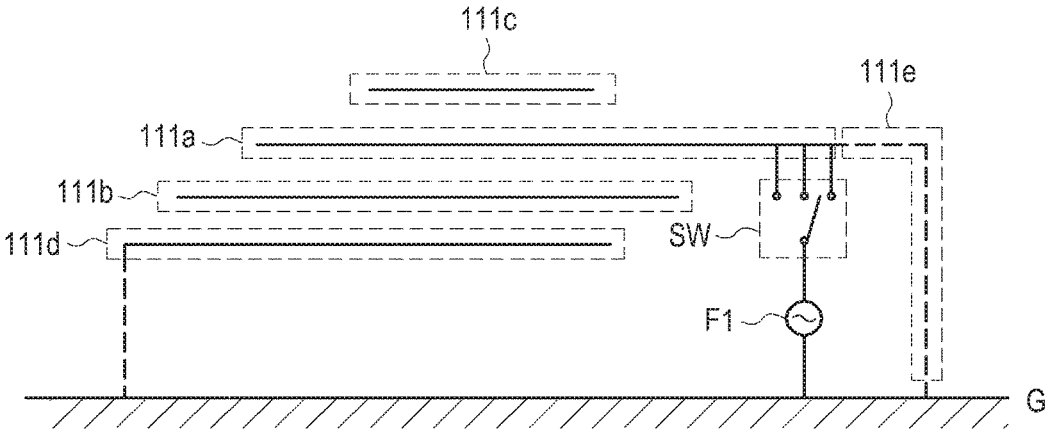
FIG. 5 is a circuit diagram of a modification example of an antenna device of an electronic device according to various embodiments of the present disclosure.

FIG. 5 is a circuit diagram of a modification example of an antenna device of an electronic device according to various embodiments of the present disclosure.

Referring to FIGS. 3 and 4, the antenna device may have a monopole antenna structure or an inverted F antenna structure. For example, once a feeding portion F is connected to the first antenna pattern 111*a*, the first antenna pattern 111*a* may operate as a monopole antenna. In the case of connection to the ground portion G through a separate path 111*e*, the first antenna pattern 111*a* may operate as an inverted F antenna. For example, depending on a feeding structure or grounding, operating characteristics of the first antenna pattern 111*a* may be implemented variously.

The first antenna pattern 111*a* is fed with electricity directly from the feeding portion F to operate as a radiation conductor, whereas the second antenna pattern 111*b* is disposed in adjacent to the first antenna pattern 111*a* to form electromagnetic-field coupling with the first antenna pattern 111*a*, thus operating as a radiation conductor. The parasitic antenna pattern 111*c* forms electromagnetic-field coupling with the first antenna pattern 111*a* in a position that is different from that of the second antenna pattern 111*b*, thus operating as a radiation conductor. For example, the first antenna pattern 111*a* may be disposed on a region between the second antenna pattern 111*b* and the parasitic antenna pattern 111*c*.

To improve the efficiency of electromagnetic-field coupling between the first antenna pattern 111*a* and the second antenna pattern 111*b* or for optimization of the antenna device, such as impedance matching or resonant frequency adjustment, the first antenna pattern 111*a* may include a slot S. The slot S may receive at least a portion of the second antenna pattern 111*b* to extend a length by which the first antenna pattern 111*a* and the second antenna pattern 111*b* are adjacent to each other. For example, in FIG. 3, if the slot S is not formed, a length by which the first antenna pattern 111*a* and the second antenna pattern 111*b* are adjacent to each other corresponds to a lengthwise length of the first antenna pattern 111*a* or the second antenna pattern 111*b*. On the other hand, as shown in FIG. 3, in a structure where the slot S is formed, a length by which the first antenna pattern 111*a* and the second antenna pattern 111*b* is adjacent to each other may be a sum of a lengthwise length of the first antenna pattern 111*a* or the second antenna pattern 111*b* and a widthwise length of the slot S. Thus, based on whether the slot S is formed or the shape or size of the slot S, the efficiency of electromagnetic-field coupling between the first antenna pattern 111*a* and the second antenna pattern 111*b* may be improved and the antenna device including the first antenna pattern 111*a* and the second antenna pattern 111*b* may be optimized.

The second antenna pattern 111*b* is disposed on the non-conductive structure, for example, the case member 101*a*, and between the first antenna pattern 111*a* and the conductive member 111*d*. As the second antenna pattern 111*b* forms electromagnetic-field coupling with the first antenna pattern 111*a*, the conductive member 111*d* forms electromagnetic-field coupling with the second antenna pattern 111*b* for use as a radiation conductor. Similarly with a case where the slot S is formed in the first antenna pattern 111*a*, by adjusting a length by which the second antenna pattern 111*b* and the conductive member 111*d* are adjacent to each other, the efficiency of electromagnetic-field coupling may be improved or the antenna device using the conductive member 111*d* as a radiation conductor may be optimized. The shape or size of the antenna patterns and the conductive member and corresponding radiation characteristics of the antenna device will be described in more detail with reference to FIG. 8.

The conductive member 111*d* may be connected to the ground portion G of the electronic device 100. For example, as the flexible conductive connector such as the connection terminal 165 is disposed on the second circuit board 106 to electrically contact the binding piece 113, the conductive member 111*d* may be connected to the ground portion G. According to various embodiments, similarly with the second antenna pattern 111*b* or the parasitic antenna pattern 111*c*, the conductive member 111*d* may not be connected to the ground portion G.

As such, the antenna device of the electronic device (e.g., the electronic device 100) according to various embodiments of the present disclosure may directly feed electricity to the first antenna pattern 111*a*, such that the first antenna pattern 111*a* then leaves and supplies a part of signal power to the second antenna pattern 111*b* through electromagnetic-field coupling and the second antenna pattern 111*b* leaves and supplies a part of signal power to the conductive member 111*d* through electromagnetic-field coupling.

Referring to FIG. 5, a path in which electricity is fed to the first antenna pattern 111*a* may be changed variously. For example, a switch member SW may be disposed between the feeding portion F and the first antenna pattern 111*a*. The switch member SW connects the feeding portion F to one of different points on the first antenna pattern 111*a*. An electric length of a part actually operating as a radiation conductor in the first antenna pattern 111*a* may change with a point at which electricity is fed on the first antenna pattern 111*a*. For example, a resonance frequency of an antenna device including the first antenna pattern 111*a* may change with an operation of the switch member SW. When a feeding path is diversified using the switch member SW, a plurality of connection terminals 165 contacting the first antenna pattern 111*a* may be disposed on the second circuit board 106.

Figure 6:
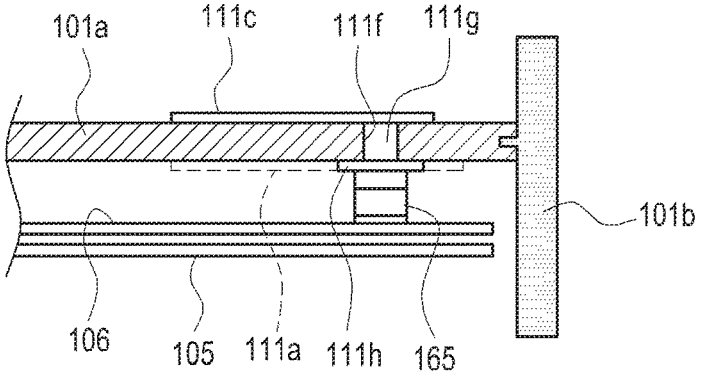
FIG. 6 is a cross-sectional view of a portion of an antenna device of an electronic device according to various embodiments of the present disclosure.

FIG. 6 is a cross-sectional view of a portion of an antenna device of an electronic device according to various embodiments of the present disclosure.

Figure 7:
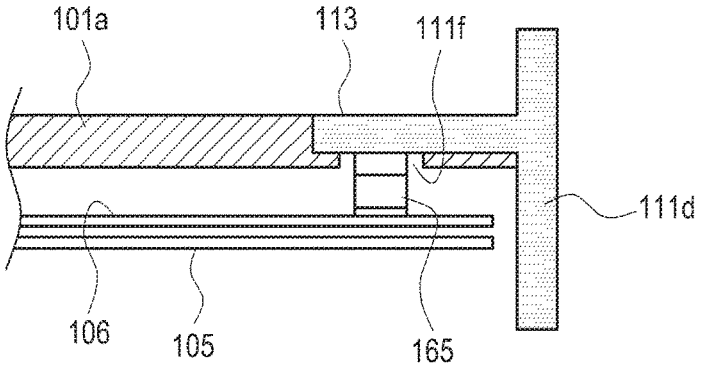
FIG. 7 is a cross-sectional view of another portion of an antenna device of an electronic device according to various embodiments of the present disclosure.

FIG. 7 is a cross-sectional view of another portion of an antenna device of an electronic device according to various embodiments of the present disclosure.

Referring to FIG. 6, the connection terminals 165 connect the first antenna pattern 111*a* to the feed portion F of the electronic device 100, for example, a communication module integrated in the IC chip 141, thereby supplying a feed signal. If the first antenna pattern 111*a* is disposed on the second surface, for example, an outer surface, of the case member 101*a*, a via hole 111*f* may be formed in the case member 101*a* and a connection pad 111*h* may be provided on the first surface, for example, an inner surface, of the case member 101*a*. Inside the case 101, the connection terminal 165 electrically contacts the connection pad 111*h* and the first antenna pattern 111*a* is electrically connected with the connection pad 111*h* through the via hole 111*f*. For example, the first antenna pattern 111*a* and the connection pad 111*h* may be disposed to correspond to the via hole 111*f*. According to various embodiments, a conductor 111*g* is disposed in the via hole 111*f* to directly connect the first antenna pattern 111*a* to the connection pad 111*h*.

Although the first antenna pattern 111*a* is formed on the second surface of the case member 101*a* according to various embodiments, the present disclosure is not limited to such an example. For example, as indicated by a dotted line in FIG. 6, the first antenna pattern 111*a* may be formed on the first surface of the case member 101*a* or both the first surface and the second surface. When the first antenna pattern 111*a* is formed on the first surface of the case member 101*a*, the first antenna pattern 111*a* may electrically and directly contact the connection terminal 165. For example, if the first antenna pattern 111*a* is formed on the first surface of the case member 101*a*, the connection pad 111*h* or the via hole 111*f* for electric connection with the connection terminal 165 may be selectively formed.

Referring to FIG. 7, the binding piece 113 extends toward the inner side of the case member 101*a* from the inner surface of the conductive member 111*d*. According to various embodiments, a portion of the case member 101*a* may partially overlap the binding piece 113. For example, as shown in FIG. 7, the binding piece 113 is exposed to the outer surface of the case member 101*a* and a portion of the case member 101*a* overlappingly faces an inner surface of the binning piece 113. When the portion of the case member 101*a* overlaps the inner surface of the binding piece 113, the case member 101*a* may further include another via hole 111*f*. For example, the portion of the binding piece 113 may be exposed to the inner surface of the case member 101*a*. One of the connection terminals 165 disposed on the second circuit board 106 may electrically contact the binding piece 113 exposed through the via hole 111*f*. The connection terminal 165 contacting the binding piece 113 may be connected to the ground portion G provided on the first circuit board 104 or the second circuit board 106.

FIGS. 8 to 13 illustrate modification examples of an antenna device of the electronic device according to various embodiments of the present disclosure.

Figure 8:
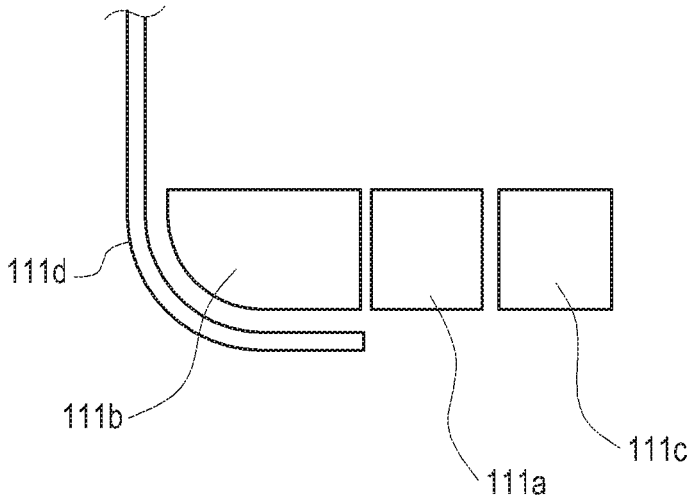
FIGS. 8 to 13 illustrate modification examples of an antenna device of an electronic device according to various embodiments of the present disclosure.

Referring to FIG. 8, the first antenna pattern 111*a*, the second antenna pattern 111*b*, and the parasitic antenna pattern 111*c* are disposed in adjacent to one another and have a polygonal shape, respectively. The conductive member 111*d* forming a portion of an exterior of the electronic device 100 may include a curved surface portion, such that the second antenna pattern 111*b* that is adjacent to the conductive member 111*d* may also include a curved line portion.

Figure 9:
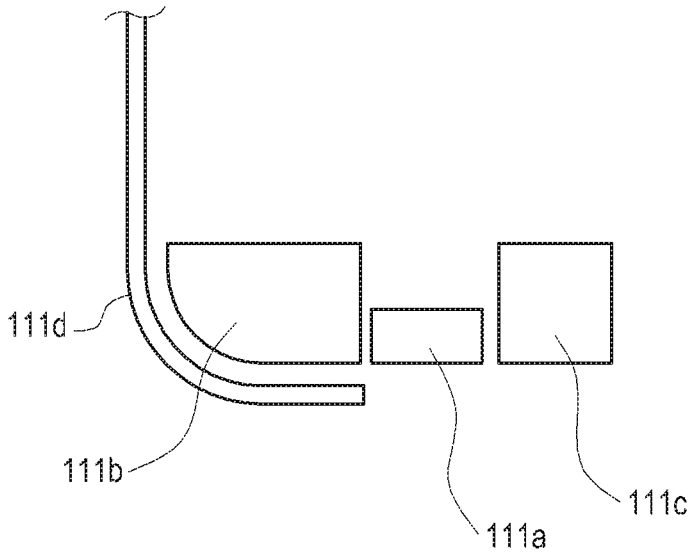

Referring to FIG. 9, the first antenna pattern 111*a*, the second antenna patter 111*b*, and the parasitic antenna pattern 111*c* have a polygonal shape, respectively, and may have different sizes. For example, a lengthwise length of the first antenna pattern 111*a* may be less than that of the second antenna pattern 111*b*. If the second antenna pattern 111*b* and the parasitic antenna pattern 111*c* have the same size as a structure shown in FIG. 8, the efficiency of electromagnetic-field coupling may be adjusted or the antenna device may be optimized, depending on the sizes of the first and second antenna patterns 111*a* and 111*b* and the parasitic antenna pattern 111*c*.

Figure 10:
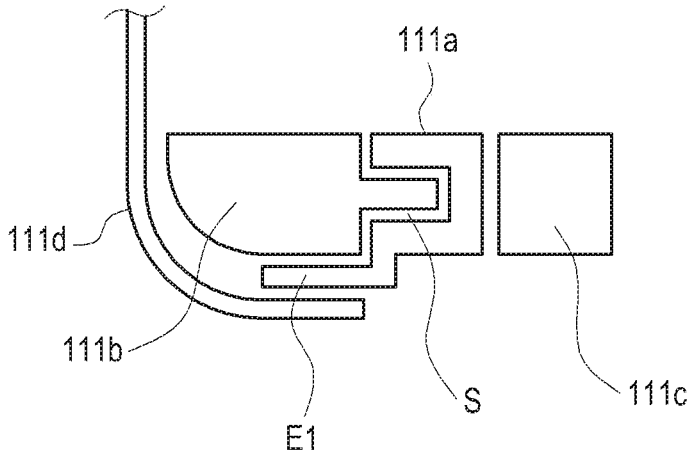

Referring to FIG. 10, the electronic device 100 may further include a first extension pattern E1 extending from the first antenna pattern 111*a*. The first extension pattern E1 may be disposed on a region between the second antenna pattern 111*b* and the conductive member 111*d*. Since the first extension pattern E1 extends from the first antenna pattern 111*a*, the first extension pattern E1 may form electromagnetic-field coupling with the second antenna pattern 111*b* and may form electromagnetic-field coupling with the conductive member 111*d*. For example, the first extension pattern E1 may be positioned in adjacent to the second antenna pattern 111*b* and the conductive member 111*d*.

Figure 11:
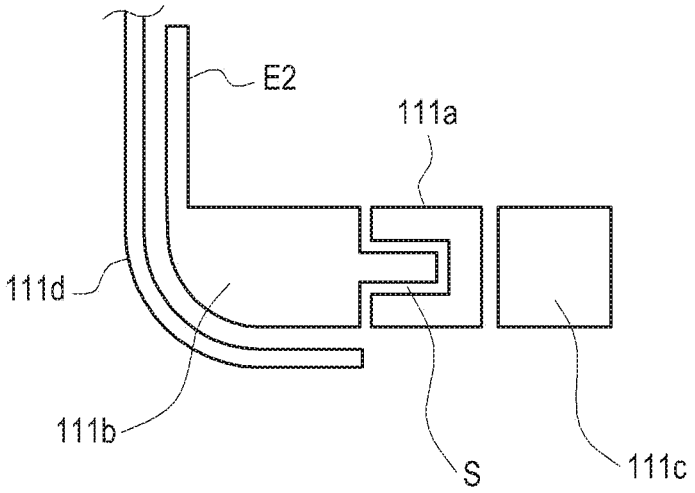

Referring to FIG. 11, the electronic device 100 may further include a second extension pattern E2 extending from the second antenna pattern 111*b*. The second extension pattern E2 may be arranged in parallel with the conductive member 111*d*. For example, the second extension pattern E2 may contribute to improvement of the efficiency of electromagnetic-field coupling between the second antenna pattern 111*b* and the conductive member 111*d*.

Figure 12:
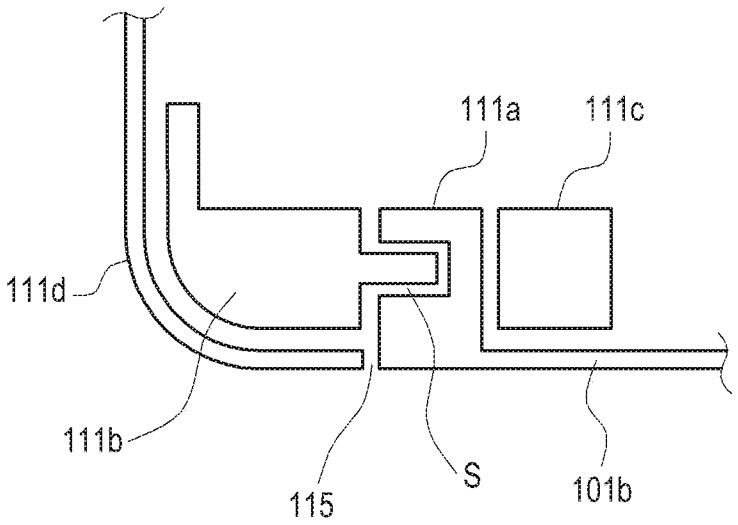

Referring to FIG. 12, the electronic device 100 connects another portion of the frame 101*b* formed of a conductive material to any one of the antenna patterns 111*a*, 111*b*, and 111*c*. In the current embodiment, another portion of the frame 101*b* is connected to the first antenna pattern 111*a*. Another portion of the frame 101*b* connected to the first antenna pattern 111*a* is positioned in adjacent to the conductive member 111*d*, having the dividing portion 115 between another portion of the frame 101*b* and the conductive member 111*d*. For example, another portion of the frame 101*b* connected to the first antenna pattern 111*a* may be insulated from the conductive member 111*d* by the dividing portion 115. As another portion of the frame 101*b* is connected to the first antenna pattern 111*a*, another portion of the frame 101*b* may be used as a portion of the antenna device.

Figure 13:
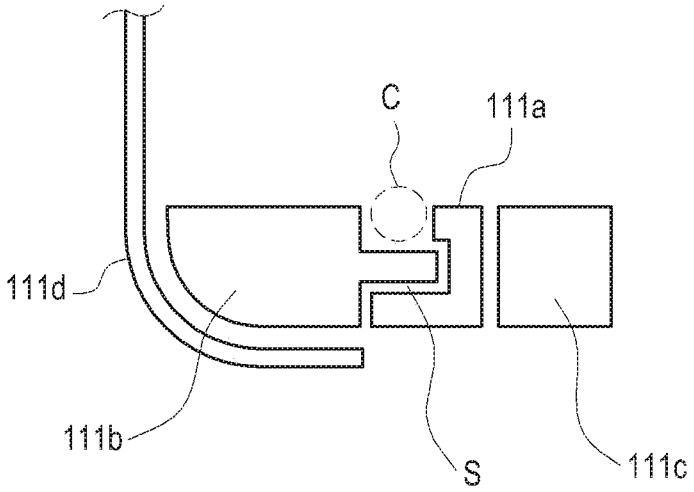

Referring to FIG. 13, in a structure where a portion of the second antenna pattern 111*b* is received (or enclosed) by the first antenna pattern 111*a* having the slot S formed therein, a portion C of the first antenna pattern 111*a* is removed to adjust the length of a portion that forms electromagnetic-field coupling between the first antenna pattern 111*a* and the second antenna pattern 111*b*.

As can be seen from FIGS. 8 to 13, the shapes or lengths of the first antenna pattern 111*a* and the second antenna pattern 111*b* may change variously, and the efficiency of electromagnetic-field coupling or the radiation characteristics of the antenna device may vary depending on the shapes or lengths of the first antenna pattern 111*a* and the second antenna pattern 111*b*. Although the shapes or lengths of the first antenna pattern 111*a* and the second antenna pattern 111*b*, whether or not the slot S is formed, and whether or not the first extension pattern E1 or the second extension pattern E2 is formed have been disclosed as embodiments, the shapes of the first antenna pattern 111*a* and the second antenna pattern 111*b* may be designed by a combination of the embodiments shown in FIGS. 8 to 13. For example, in the embodiment shown in FIG. 8, either the slot S or the first extension pattern E1 or the second extension pattern E2 is not formed, but depending on the specifications of an electronic device, the first extension pattern E1 or the second extension pattern E2 may be added to a polygonal antenna pattern to adjust the efficiency of electromagnetic-field coupling between antenna patterns and to optimize the antenna device, for example, through impedance matching.

Figure 14:
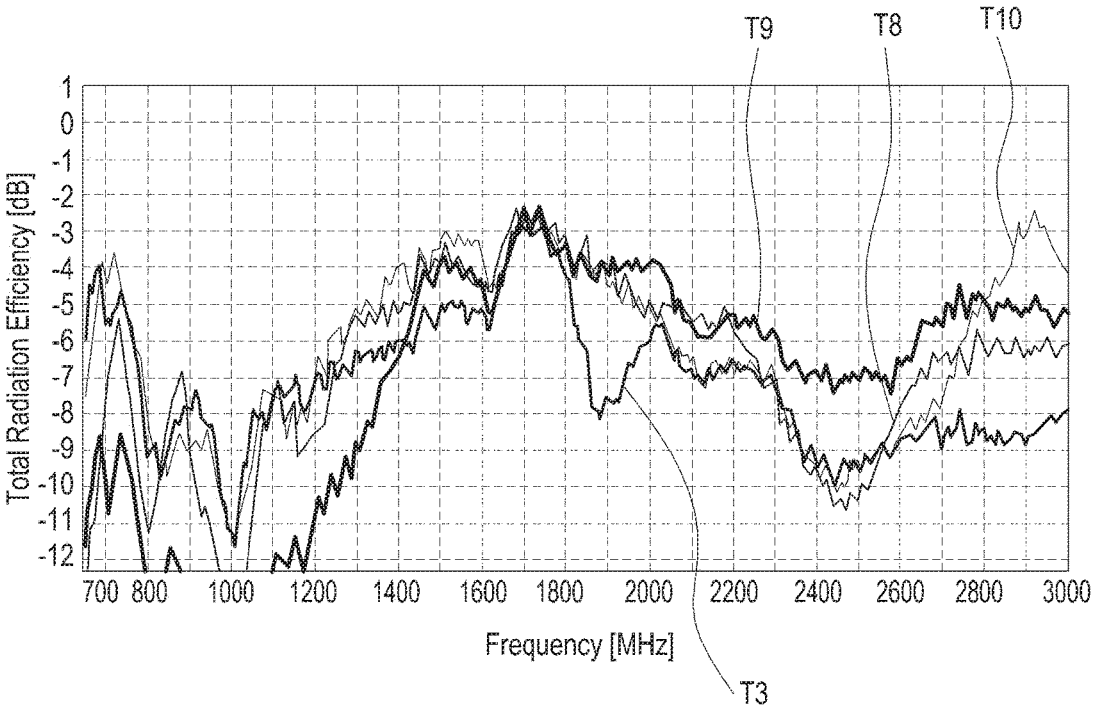
FIG. 14 is a graph illustrating results of measurement of total radiation efficiency with respect to modifications of an antenna device of an electronic device according to various embodiments of the present disclosure.

FIG. 14 is a graph illustrating results of measurement of total radiation efficiency with respect to modifications of an antenna device of an electronic device according to various embodiments of the present disclosure.

Referring to FIG. 14, a graph indicated by 'T3' shows a total radiation efficiency of the antenna device structured as shown in FIG. 3, a graph indicated by 'T8' shows a total radiation efficiency of the antenna device structured as shown in FIG. 8, a graph indicated by 'T9' shows a total radiation efficiency of the antenna device structured as shown in FIG. 9, and a graph indicated by 'T10' shows a total radiation efficiency of the antenna device structured as shown in FIG. 10.

As shown in FIG. 14, the antenna device of the electronic device 100 may secure a radiation efficiency higher than a predetermined level (e.g., −3 dB) in an intermediate frequency band (e.g., a frequency band around 1.7 GHz) even if the shape or length of the first antenna pattern 111*a* or the second antenna pattern 111*b* changes. On the other hand, the antenna device of the electronic device 100 shows a significant change in a radiation efficiency in a low frequency band (e.g., a frequency band around 700 MHz) as the shape or length of the first antenna pattern 111*a* or the second antenna pattern 111*b* changes. For example, by forming the first antenna pattern 111*a* and the second antenna pattern 111*b* shaped as shown in FIG. 3 or 10, a resonant frequency with a stable radiation efficiency may be secured even in a low frequency band.

As such, the antenna device of the electronic device 100 according to various embodiments of the present disclosure may have a different radiation efficiency in at least one frequency band, depending on the shape or length of the first antenna pattern 111*a* or the second antenna pattern 111*b*. For example, as mentioned before, an electromagnetic-field coupling efficiency between antenna patterns may change, and the shape or length of the first antenna pattern 111*a* or the second antenna pattern 111*b* may be designed suitably for optimization of the antenna device such as impedance matching, resonant frequency adjustment, or the like. Thus, even when the shape or size of the conductive member 111*d* is not changed, designing or manufacturing of the antenna device suitable for the specifications of the electronic device may be facilitated.

Figure 15:
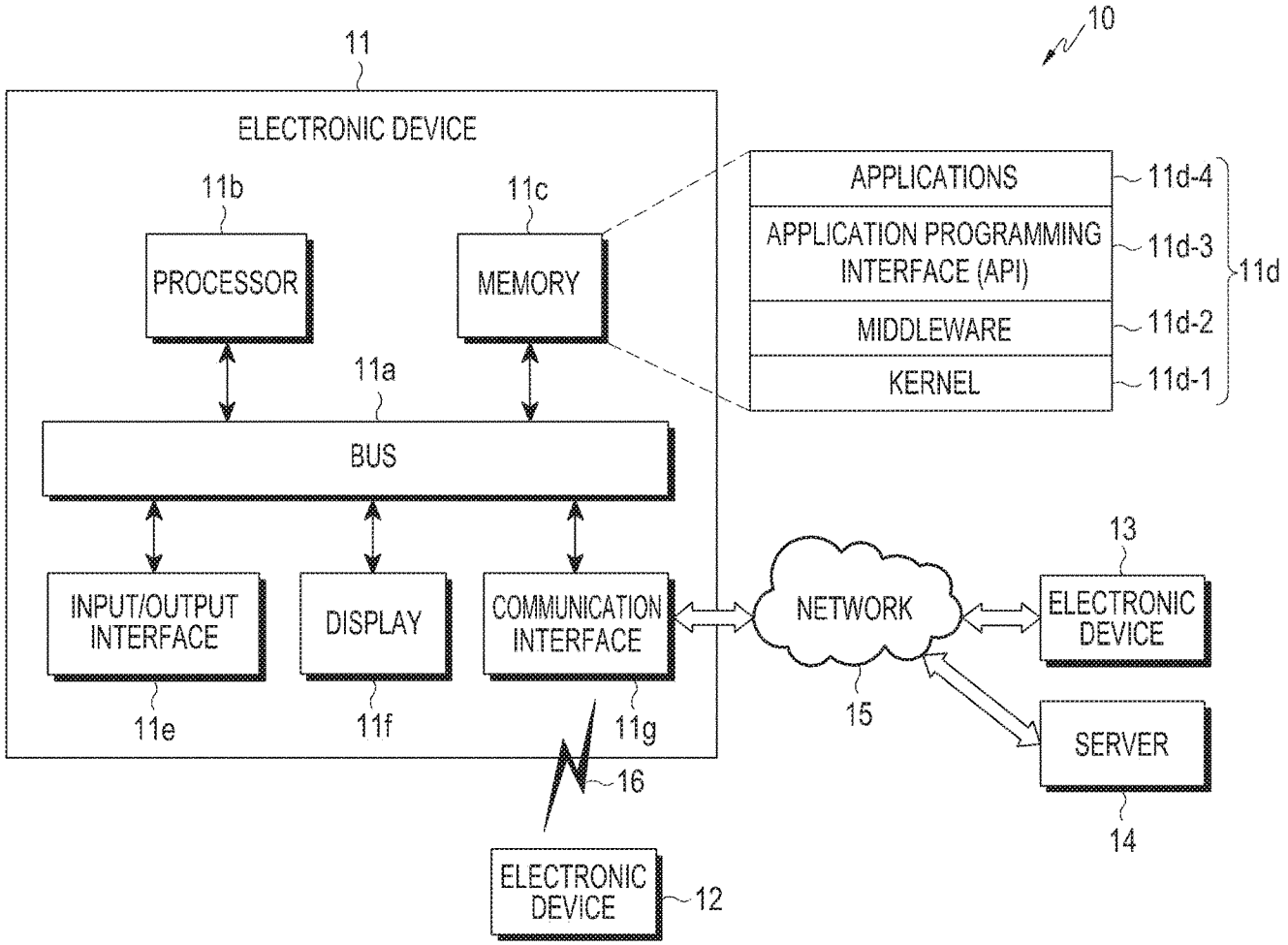
FIG. 15 illustrates a network environment including an electronic device according to various embodiments of the present disclosure.

Referring to FIG. 15, an electronic device 11 (e.g., the electronic device 100) in a network environment 10 according to various embodiments will be described. The electronic device 11 may include a bus 11*a*, a processor 11*b*, a memory 11*c*, an input/output (I/O) interface 11*e*, a display 11*f*, and a communication interface 11*g*. In some embodiments, at least one of the foregoing elements may be omitted from or other elements may be added to the electronic device 11.

The bus 11*a* may include a circuit for interconnecting the elements 11*a* through 17*g* described above and for allowing communication (e.g., a control message and/or data) between the elements 11*a* through 17*g*.

The processor 11*b* may include one or more of a CPU, an AP, and a communication processor (CP). The processor 11*b* performs operations or data processing for control and/or communication of, for example, at least one other elements of the electronic device 11.

The memory 11*c* may include a volatile and/or nonvolatile memory. The memory 11*c* may store, for example, commands or data associated with at least one other elements of the electronic device 11 According to an embodiment of the present disclosure, the memory 11*c* may store software and/or a program 11*d*. The program 11*d* may include, for example, a kernel 11*d*-1, middleware 11*d*-2, an application programming interface (API) 11*d*-3, and/or an application program (or an application) 11*d*-4. At least some of the kernel 11*d*-1, the middleware 11*d*-2, and the API 11*d*-3 may be referred to as an operating system (OS).

The kernel 11*d*-1 controls or manages, for example, system resources (e.g., the bus 11*a*, the processor 11*b*, or the memory 11*c*) used to execute an operation or a function implemented in other programs (e.g., the middleware 11*d*-2, the API 11*d*-3, or the application program 11*d*-4). The kernel 11*d*-1 provides an interface through which the middleware 11*d*-2, the API 11*d*-3, or the application program 11*d*-4 accesses separate components of the electronic device 11 to control or manage the system resources.

The middleware 11*d*-2 may work as an intermediary for allowing, for example, the API 11*d*-3 or the application program 11*d*-4 to exchange data in communication with the kernel 11*d*-1.

The middleware 11*d*-2 may process one or more task requests received from the application program 11*d*-4 according to priorities. For example, the middleware 11*d*-2 may give priorities for using a system resource (e.g., the bus 11*a*, the processor 11*b*, or the memory 11*c*) of the electronic device 11 to at least one of the application programs 11*d*-4. The middleware 11*d*-2 may perform control (e.g., scheduling or load balancing) with respect to the one or more task requests according to the priorities given to the at least one of the application programs 11*d*-4.

The API 11*d*-3 is an interface used for the application 11*d*-4 to control a function provided by the kernel 11*d*-1 or the middleware 11*d*-2, and may include, for example, at least one interface or function (e.g., a command) for file control, window control, image processing or character control.

The I/O interface 11*e* serves as an interface for delivering a command or data input from a user or another external device to other element(s) 11*a* through 17*g* of the electronic device 11. The I/O interface 11*e* may also output a command or data received from other element(s) 11*a* through 17*g* of the electronic device 11 to a user or another external device.

The display 11*f* may include, for example, a liquid crystal display (LCD), a light emitting diode (LED) display, an organic LED (OLED) display, a microelectromechanical system (MEMS) display, or an electronic paper display. The display 11*f* may display various contents (e.g., a text, an image, video, an icon, or a symbol) to users. The display 11*f* may include a touch screen, and receives a touch, a gesture, proximity, or a hovering input, for example, by using an electronic pen or a part of a body of a user.

The communication interface 11*g* sets up communication, for example, between the electronic device 11 and an external device (e.g., a first external electronic device 12, a second external electronic device 13, or a server 14). For example, the communication interface 11*g* is connected to a network 15 through wireless or wired communication to communicate with the external device (e.g., the second external electronic device 13 or the server 14).

The wireless communication may use, as a cellular communication protocol, for example, at least one of long term evolution (LTE), LTE-advanced (LTE-A), code division multiple access (CDMA), wideband CDMA (WCDMA), a universal mobile telecommunication system (UNITS), wireless broadband (WiBro), or global system for mobile communications (GSM)). The wireless communication may use, as a cellular communication protocol, for example, at least one of LTE, LTE-A, CDMA, WCDMA, a UMTS, WiBro, or GSM). Wireless communication may include short-range communication 16. The short-range communication 16 may include at least one of WiFi, Bluetooth (BT), near field communication (NFC), and global navigation satellite system (GNSS). Depending on a usage area or bandwidth, the GNSS may include at least one of a global positioning system (GPS), a global navigation satellite system (Glonass), a Beidou navigation satellite system ("Beidou"), and Galileo, the European global satellite-based navigation system. Herein, "GPS" may be used interchangeably with "GNSS". The wired communication may include, for example, at least one of a universal serial bus (USB), a high definition multimedia interface (HDMI), a recommended standard (RS)-2032, and a plain old telephone service (POTS). The network 15 may include a telecommunications network, for example, at least one of a computer network (e.g., a LAN or a WAN), Internet, and a telephone network.

Each of the first external electronic device 12 and the second external electronic device 13 may be a device of the same type as or a different type than the electronic device 11 According to an embodiment of the present disclosure, the server 106 may include a group of one or more servers. According to various embodiments, all or some of operations performed in the electronic device 11 may be performed in another electronic device or a plurality of electronic devices (e.g., the external electronic devices 12 and 13 or the server 14). According to an embodiment of the present disclosure, when the electronic device 11 has to perform a function or a service automatically or at the request, the electronic device 11 may request another device (e.g., the external electronic devices 12 and 13 or the server 14) to perform at least some functions associated with the function or the service instead of or in addition to executing the function or the service. The other electronic device (e.g., the external electronic devices 12 and 13 or the server 14) may perform the requested function or an additional function and delivers the result to the electronic device 11. The electronic device 11 provides the received result or provides the requested function or service by processing the received result. To this end, for example, cloud computing, distributed computing, or client-server computing may be used.

Figure 16:
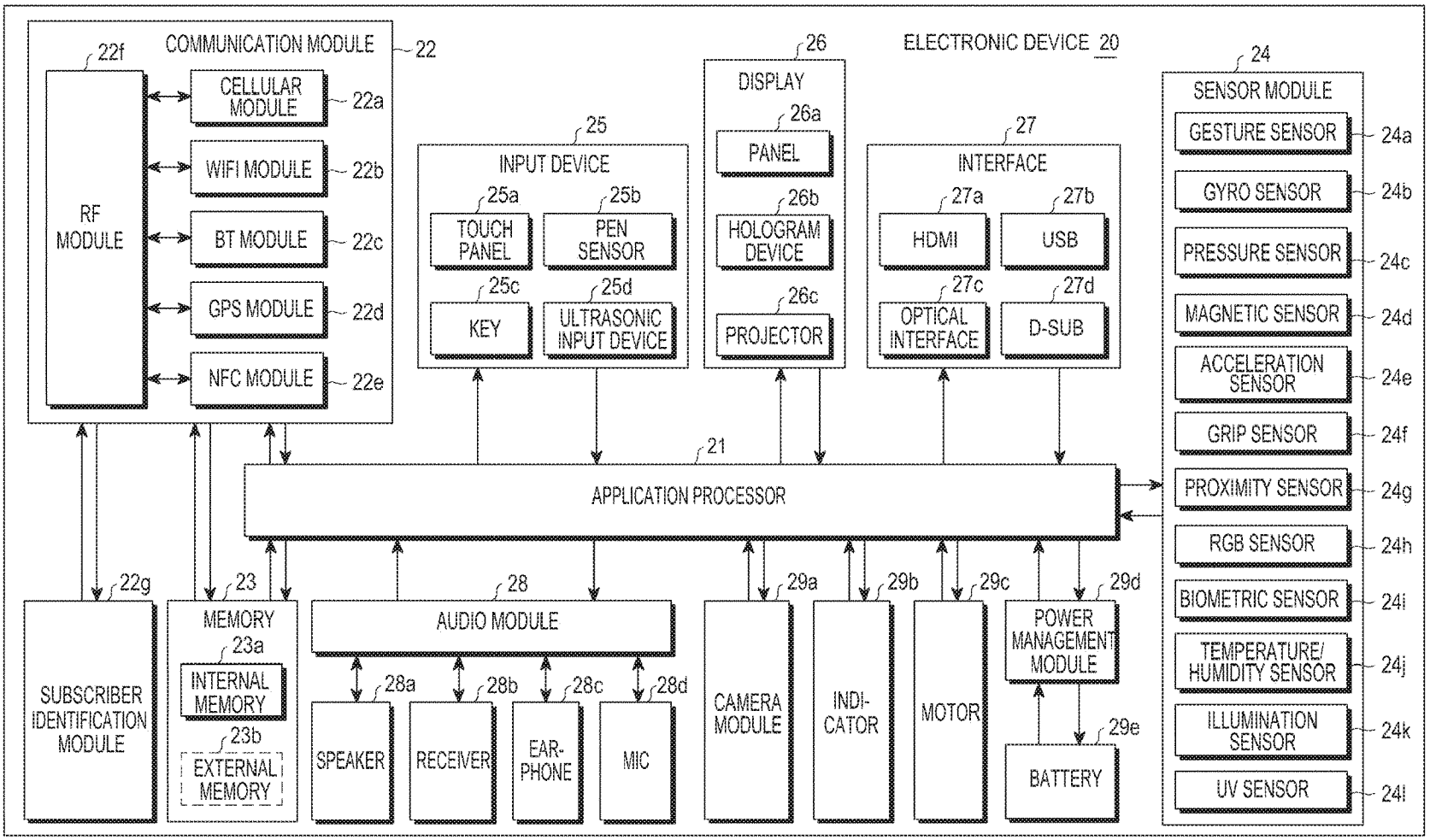
FIG. 16 is a block diagram of an electronic device according to various embodiments of the present disclosure.

FIG. 16 is a block diagram of an electronic device according to various embodiments of the present disclosure. The electronic device may include the entire electronic device 100 illustrated in FIG. 1 or a part of the electronic device 11 illustrated in FIG. 15.

Referring to FIG. 16, an electronic device 20 may include one or more APs 21, a communication module 22, a subscriber identification module (SIM) 22*g*, a memory 23, a sensor module 24, an input module 25, a display 26, an interface 27, an audio module 28, a camera module 29*a*, a power management module 29*d*, a battery 29*e*, an indicator 29*d*, and a motor 29*c*.

The processor 21 controls multiple hardware or software components connected to the processor 21 by driving an OS or an application program, and performs processing and operations with respect to various data including multimedia data. The processor 21 may be implemented with, for example, a system on chip (SoC). According to an embodiment, the processor 21 may further include a graphic processing unit (GPU) and/or an image signal processor (ISP). The processor 21 may include at least some of the elements illustrated in FIG. 16 (e.g., a cellular module 22*a*). The processor 21 loads a command or data received from at least one of other elements (e.g., a non-volatile memory) into a volatile memory and processes the command or data and stores various data in the non-volatile memory.

The communication module 22 may have a configuration that is the same as or similar to the communication interface 11*g* illustrated in FIG. 15. The communication module 21 may include, for example, the cellular module 22*a*, a WiFi module 22*b*, a BT module 22*c*, a GNSS module 22*d* (e.g., a GPS module, a Glonass module, a Beidou module, or Galileo module), a NFC module 22*e*, and a radio frequency (RF) module 22*f*. At least some of the antenna devices of the electronic device 20 may be connected with the communication module 22.

The cellular module 22*a* may provide, for example, a voice call, a video call, a text service, or an Internet service over a communication network. According to an embodiment, the cellular module 22*a* may identify and authenticate the electronic device 20 in a communication network by using a SIM (e.g., the SIM 22*g*). According to an embodiment, the cellular module 22*a* performs at least one of functions that may be provided by the processor 21. According to an embodiment, the cellular module 22*a* may include a CP.

At least one of the WiFi module 22*b*, the BT module 22*c*, the GPS module 22*d*, and the NFC module 22*e* may include a processor for processing data transmitted and received by a corresponding module. According to some embodiment, at least some (e.g., two or more) of the cellular module 22*a*, the WiFi module 22*b*, the BT module 22*c*, the GNSS module 22*d*, and the NFC module 22*e* may be included in one IC or IC package.

The RF module 22*f* may transmit and receive a communication signal (e.g., an RF signal). The RF module 22*f* may include a transceiver, a power amp module (PAM), a frequency filter, a low noise amplifier (LNA), or an antenna. According to another embodiment, at least one of the cellular module 22*a*, the WiFi module 22*b*, the BT module 22*c*, the GNSS module 22*d*, and the NFC module 22*e* may transmit and receive an RF signal through a separate RF module.

The SIM 22*g* may include a card including an SIM and/or an embedded SIM, and may include unique identification information (e.g., an integrated circuit card identifier (ICCID) or subscriber information (e.g., an international mobile subscriber identity (IMSI)).

The memory 23 (e.g., the memory 11*c*) may include an internal memory 23*a* or an external memory 23*b*. The internal memory 23*a* may include at least one of a volatile memory (e.g., dynamic random access memory (DRAM), static RAM (SRAM), synchronous DRAM (SDRAM), and a non-volatile memory (e.g., one time programmable read only memory (OTPROM), programmable ROM (PROM), erasable and programmable ROM (EPROM), electrically EPROM (EEPROM), mask ROM, flash ROM, NAND flash memory, or NOR flash memory), and a solid state drive (SSD).

The external memory 23*b* may further include flash drive, for example, compact flash (CF), secure digital (SD), micro-SD, mini-SD, extreme digital (xD), a multimedia card (MMC), or a memory stick. The external memory 23*b* may be functionally and/or physically connected with the electronic device 20 through various interfaces.

The sensor module 24 measures physical quantity or senses an operation state of the electronic device 20 to convert the measured or sensed information into an electric signal. The sensor module 24 may include at least one of a gesture sensor 24*a*, a gyro sensor 24*b*, a pressure sensor 24*c*, a magnetic sensor 24*d*, an acceleration sensor 24*e*, a grip sensor 24*f*, a proximity sensor 24*g*, a color sensor 24*h* (e.g., red, green, blue (RGB) sensor), a biometric sensor 24*i*, a temperature/humidity sensor 24*j*, an illumination sensor 24*k*, and a ultraviolet (UV) sensor 24*l*. Additionally or alternatively, the sensor module 24 may include an e-nose sensor (not shown), an electromyography (EMG) sensor (not shown), an electroencephalogram (EEG) sensor (not shown), an electrocardiogram (ECG) sensor (not shown), or a fingerprint sensor. The sensor module 24 may further include a control circuit for controlling at least one sensor included therein. In some embodiment, the electronic device 20 may further include a processor configured to control the sensor module 24 as part of or separately from the processor 21, to control the sensor module 24 during a sleep state of the processor 21.

The input module 25 may include a touch panel 25*a*, a (digital) pen sensor 25*b*, a key 25*c*, or an ultrasonic input device 25*d*. The touch panel 25*a* may use at least one of a capacitive type, a resistive type, an infrared (IR) type, or an ultrasonic type. The touch panel 25*a* may further include a control circuit. The touch panel 25*a* may further include a tactile layer to provide tactile reaction to the user.

The (digital) pen sensor 25*b* may include a recognition sheet which is a part of the touch panel 25*a* or a separate recognition sheet. The key 25*c* may also include a physical button, an optical key, or a keypad. The ultrasonic input device 25*d* senses ultrasonic waves generated in an input means for generating the ultrasonic waves through a microphone (e.g., a microphone 28*d*) and checks data corresponding to the sensed ultrasonic waves.

The display 26 (e.g., the display 110 may include a panel 26*a*, a hologram device 26*b*, or a projector 26*c*. The panel

26*a* may have a configuration that is the same as or similar to that of the display 11*f* of FIG. 15. The panel 26*a* may be implemented to be flexible, transparent, or wearable. The panel 26*a* may be configured with the touch panel 25*a* in one module. The hologram device 26*b* shows a stereoscopic image in the air by using interference of light. The projector 26*c* displays an image onto an external screen through projection of light. The screen may be positioned inside or outside the electronic device 20. According to an embodiment, the display 26 may further include a control circuit for controlling the panel 25*a*, the hologram device 26*b*, or the projector 26*c*.

The interface 27 may include a HDMI 27*a*, a USB 27*b*, an optical communication 27*c*, or a D-subminiature 27*d*. The interface 27 may be included in the communication interface 11*g* illustrated in FIG. 15. Additionally or alternatively, the interface 27 may include a mobile high-definition link (MHL) interface, an SD/MMC interface, or an infrared data association (IrDA) interface.

The audio module 28 bi-directionally converts sound and an electric signal. At least one element of the audio module 28 may be included in the I/O interface 11*d*-3 illustrated in FIG. 15. The audio module 28 processes sound information input or output through a speaker 28*a*, a receiver 28*b*, an earphone 28*c*, or the microphone 28*d*.

The camera module 29*a* is a device capable of capturing a still image or a moving image, and according to an embodiment, may include one or more image sensors (e.g., a front sensor or a rear sensor), a lens, an ISP, or a flash (e.g., an LED or a xenon lamp).

The power management module 29*d* manages power of the electronic device 20. According to an embodiment, the power management module 29*d* may include a power management integrated circuit (PMIC), a charger IC, or a battery fuel gauge. The PMIC may have a wired and/or wireless charging scheme. The wireless charging scheme includes a magnetic-resonance type, a magnetic induction type, and an electromagnetic type, and for wireless charging, an additional circuit, for example, a coil loop, a resonance circuit, or a rectifier may be further included. The battery gauge measures the remaining capacity of the battery 29*e* or the voltage, current, or temperature of the battery 29*e* during charging. The battery 29*e* may include a rechargeable battery and/or a solar battery.

The indicator 29*b* displays a particular state, for example, a booting state, a message state, or a charging state, of the electronic device 20 or a part thereof (e.g., the processor 21). The motor 29*c* converts an electric signal into mechanical vibration or generates vibration or a haptic effect. Although not shown, the electronic device 20 may include a processing device (e.g., a GPU) for supporting a mobile TV. The processing device for supporting the mobile TV processes media data according to, a standard such as digital multimedia broadcasting (DMB), digital video broadcasting (DVB), or mediaFlo™.

Each of the foregoing elements described herein may include one or more components, and a name of the part may vary with a type of the electronic device 20. The electronic device according to the present disclosure may include at least one of the foregoing elements, and some of the elements may be omitted therefrom or other elements may be further included therein. As some of the elements of the electronic device according to the present disclosure are coupled into one entity, the same function as those of the elements that have not been coupled may be performed.

Figure 17:
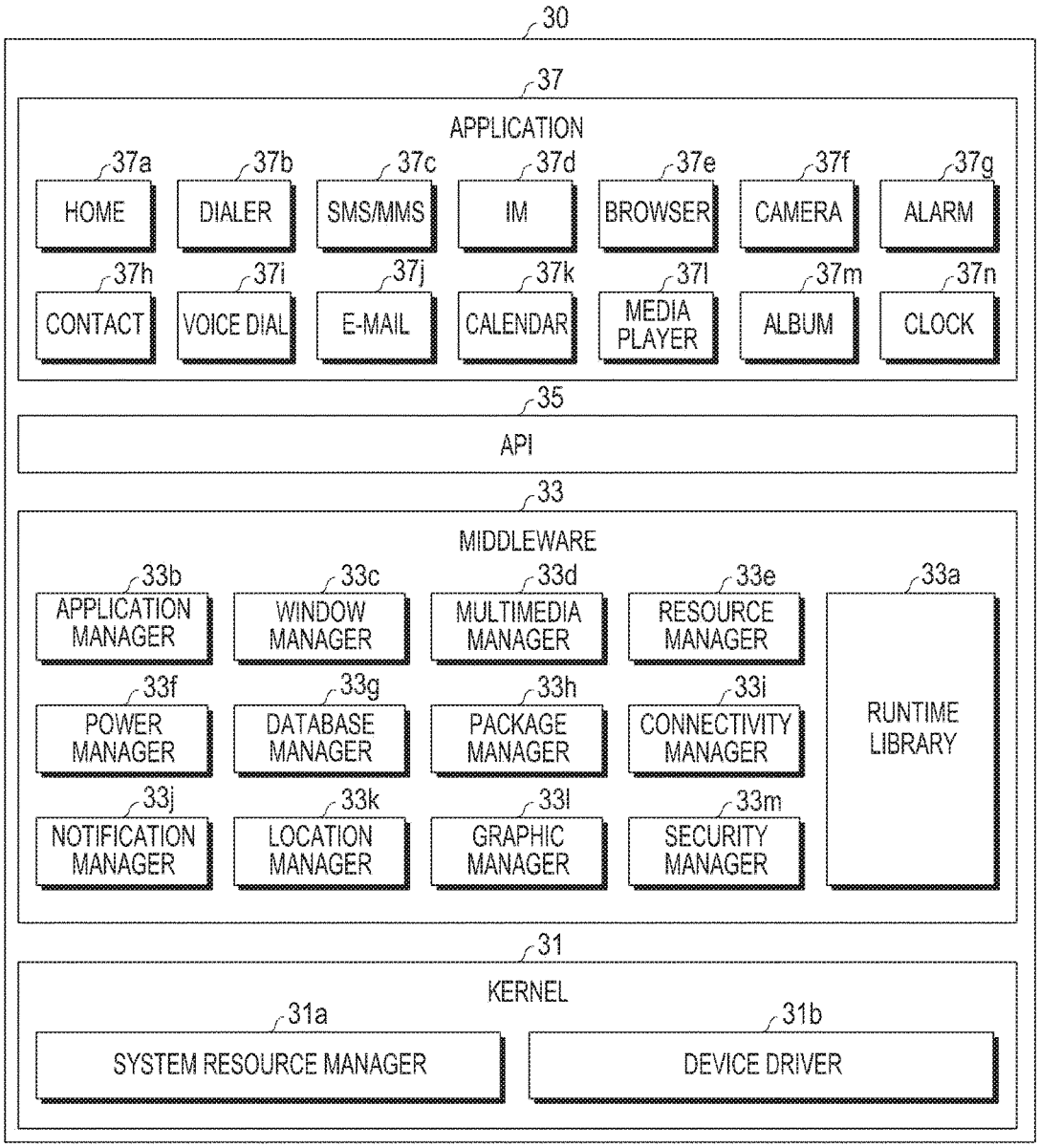
FIG. 17 is a block diagram of a programming module of an electronic device according to various embodiments of the present disclosure.

FIG. 17 is a block diagram of a programming module according to various embodiments of the present disclosure. According to an embodiment, the programming module (e.g., the program 11*d*-4) may include an OS for controlling resources associated with an electronic device (e.g., the electronic device 11) and/or various applications executed on the OS. The OS may include Android, iOS, Windows, Symbian, Tizen, or Bada.

Referring to FIG. 17, a programming module 30 may include a kernel 31, a middleware 33, an API 35, and/or an application 37. At least a part of the programming module 30 may be preloaded on an electronic device or may be downloaded from an external device (e.g., the external electronic device 12 or 13 or the server 14).

The kernel 31 (e.g., the kernel 11*d*-1) may include a system resource manager 31*a* and/or a device driver 31*b*. The system resource manager 31*a* may perform control, allocation, or retrieval of system resources. According to an embodiment, the system resource manager 31*a* may include a process management unit, a memory management unit, or a file system. The device driver 31*b* may include, for example, a display driver, a camera driver, a BT driver, a shared memory driver, a USB driver, a keypad driver, a WiFi driver, an audio driver, or an inter-process communication (IPC) driver.

The middleware 33 may include provide functions that the application 37 commonly requires or provide various functions to the application 37 through the API 35 to allow the application 37 to efficiently use a limited system resource in an electronic device. According to an embodiment, the middleware 33 (e.g., the middleware 11*d*-2) may include at least one of a runtime library 33*a*, an application manager 33*b*, a window manager 33*c*, a multimedia manager 33*d*, a resource manager 33*e*, a power manager 33*f*, a database manager 33*g*, a package manager 33*h*, a connectivity manager 33*i*, a notification manager 33*j*, a location manager 33*k*, a graphic manager 33*l*, and a security manager 33*m*.

The runtime library 33*a* may include a library module that a compiler uses to add a new function through a programming language while the application 37 is executed. The runtime library 33*a* performs functions relating to an I/O, memory management, or calculation operation.

The application manager 33*b* manages a life cycle of at least one application among the applications 37. The window manager 33*c* manages a graphical user interface (GUI) resource using a screen. The multimedia manager 33*d* recognizes a format necessary for playing various media files and performs encoding or decoding on a media file by using a codec appropriate for a corresponding format. The resource manager 33*e* manages a resource such as source code, memory, or storage space of at least one application among the applications 37.

The power manager 33*f* manages a battery or power in operation with a basic input/output system (BIOS) and provides power information necessary for an operation of the electronic device. The database manager 33*g* performs a management operation to generate, search or change a database used for at least one application among the applications 37. The package manager 33*h* manages the installation or update of an application distributed in a package file format.

The connectivity manager 33*i* manages a wireless connection such as a WiFi or BT connection. The notification manager 33*j* displays or notifies events such as arrival messages, appointments, and proximity alerts in a manner that is not disruptive to a user. The location manager 33*k* manages location information of an electronic device. The graphic manager 33*l* manages a graphic effect to be provided to a user or a user interface (UI) related thereto. The security manager 33*m* provides a general security function necessary for system security or user authentication. According to an embodiment of the present disclosure, when an electronic device (e.g., the electronic device 11) has a call function, the middleware 33 may further include a telephony manager for managing a voice or video call function of the electronic device.

The middleware 33 may include a middleware module forming a combination of various functions of the above-mentioned internal elements. The middleware 33 may provide modules specified according to types of OS so as to provide distinctive functions. Additionally, the middleware 33 may delete some of existing elements or add new elements dynamically.

The API 35 (e.g., the API 11*d*-3) may be provided as a set of API programming functions with a different configuration according to the OS. In the case of Android or iOS, for example, one API set may be provided by each platform, and in the case of Tizen, two or more API sets may be provided.

The application 37 (e.g., the application program 11*d*-4) may include one or more applications capable of providing a function, for example, a home application 37*a*, a dialer application 37*b*, a short messaging service (SMS)/multimedia messaging service (MMS) application 37*c*, an instant message (IM) application 37*d*, a browser application 37*e*, a camera application 37*f*, an alarm application 37*g*, a contact application 37*h*, a voice dial application 37*i*, an e-mail application 37*j*, a calendar application 37*k*, a media player application 37*l*, an album application 37*m*, a clock application 37*n*, a health care application (e.g., an application for measuring an exercise amount or a blood sugar), or an environment information providing application (e.g., an application for providing air pressure, humidity, or temperature information).

According to an embodiment of the present disclosure, the application 37 may include an application (hereinafter, an "information exchange application" for convenience) supporting information exchange between the electronic device (e.g., the electronic device 11) and an external electronic device (e.g., the external electronic device 12 or 13). The information exchange application may include, for example, a notification relay application for transferring specific information to the external electronic device or a device management application for managing the external electronic device.

For example, the notification relay application may include a function for transferring notification information generated in another application (e.g., an SMS/MMS application, an e-mail application, a health care application, or an environment information application) of the electronic device to an external electronic device (e.g., the external electronic device 12 or 13). The notification relay application may receive notification information from an external electronic device to provide the same to a user.

The device management application may manage (e.g., install, remove, or update) at least one function (e.g., turn on/turn off of an external electronic device itself (or a part thereof) or control of brightness (or resolution) of a display, a service provided by an application operating in an external electronic device or provided by the external electronic device (e.g., a call service or a message service).

According to an embodiment, the application 37 may include an application designated according to an attribute of the external electronic device (e.g., device health care application of mobile medical equipment). According to an embodiment, the application 37 may include an application received from the external electronic device (e.g., the server 14 or the external electronic device 12 or 13). According to an embodiment, the application 37 may include a preloaded application or a third party application that may be downloaded from the server. Names of elements of the programming module 30 according to the illustrated embodiment may vary depending on a type of an OS.

According to various embodiments, at least a part of the programming module 30 may be implemented by software, firmware, hardware, or a combination of at least two of them. The at least a part of the programming module 30 may be implemented (e.g., executed) by a processor (e.g., the processor 21). The at least a part of the programming module 30 may include a module, a program, a routine, sets or instructions, or a process for performing one or more functions.

A term "module" used herein may mean, for example, a unit including one of or a combination of two or more of hardware, software, and firmware. The "module" may be interchangeably used with a unit, logic, a logical block, a component, or a circuit. The "module" may be a minimum unit or a portion of an integrated component. The "module" may be a minimum unit or a portion thereof performing one or more functions. The "module" may be implemented mechanically or electronically. For example, the "module" according to the embodiments may include at least one of an application-specific integrated circuit (ASIC) chip, field-programmable gate arrays (FPGAs), and a programmable-logic device performing certain operations already known or to be developed.

At least a part of a device (for example, modules or functions thereof) or a method (for example, operations) according to various embodiments of the present disclosure may be implemented with a command stored in a computer-readable storage medium in the form of a program module. When the command is executed by a processor (for example, the processor 11*b*), the one or more processors may perform a function corresponding to the command. The computer-readable storage medium may be, for example, the memory 11*c*.

The computer readable recording medium includes magnetic media such as hard disk, floppy disk, or magnetic tape, optical media such as compact disc ROM (CD-ROM) or digital versatile disc (DVD), magneto-optical media such as floptical disk, and a hardware device such as ROM. RAM, flash memory storing and executing program commands. Further, the program instructions include a machine language code created by a complier and a high-level language code executable by a computer using an interpreter. The foregoing hardware device may be configured to be operated as at least one software module to perform an operation of the present disclosure, or vice versa.

Modules or programming modules according to various embodiments of the present disclosure may include one or more of the foregoing elements, have some of the foregoing elements omitted, or further include additional other elements. Operations performed by the modules, the programming modules or other elements may be executed in a sequential, parallel, repetitive or heuristic manner. Also, some of the operations may be executed in different order or omitted, or may have additional different operations.

An electronic device according to various embodiments of the present disclosure includes a front cover forming a front surface of the electronic device, a rear cover forming a rear surface of the electronic device, a sidewall at least partially enclosing a space formed between the front cover and the rear cover and at least partially formed of a conductive member, a display disposed in the space and including a screen region exposed through the front cover, a non-conductive structure disposed in adjacent to or in contact with the sidewall in the space and including a first surface facing the front cover and a second surface facing the rear cover, a first antenna pattern overlapping the non-conductive structure when viewed from top of the non-conductive structure and fed with electricity, a second antenna pattern overlapping the non-conductive structure when viewed from top of the non-conductive structure and disposed in adjacent to the first antenna pattern to form electromagnetic-field coupling with the first antenna pattern, and at least one IC chip feeding electricity to the first antenna pattern, in which the conductive member of the sidewall forms electromagnetic-field coupling with the second antenna pattern, such that the first antenna pattern, the second antenna pattern, and the conductive member form a portion of an antenna device.

According to various embodiments, the electronic device may further include a parasitic antenna pattern overlapping the non-conductive structure when viewed from top of the non-conductive structure and disposed in adjacent to the first antenna pattern to form electromagnetic-field coupling with the first antenna pattern.

According to various embodiments, the first antenna pattern may be positioned on a region between the second antenna pattern and the parasitic antenna pattern.

According to various embodiments, the second antenna pattern may be positioned on a region between the first antenna pattern and the conductive member.

According to various embodiments, the electronic device may further include a slot formed in the first antenna pattern to receive at least a portion of the second antenna pattern.

According to various embodiments, the electronic device may further include a first extension pattern extending from the first antenna pattern and positioned on a portion of a region between the second antenna pattern and the conductive member.

According to various embodiments, electromagnetic-field coupling may be formed between the first extension pattern and the conductive member.

According to various embodiments, the electronic device may further include a second extension pattern extending from the second antenna pattern and disposed in parallel with the conductive member.

According to various embodiments, the electronic device may further include a ground portion connected to the conductive member to provide grounding.

According to various embodiments, the electronic device may further include a circuit board received in an inner space formed by the sidewall and the non-conductive structure, in which the ground portion is provided on the circuit board.

According to various embodiments, the electronic device may further include a flexible conductive connector mounted on the circuit board and connected to the ground portion, in which the flexible conductive connector connects the conductive member to the ground portion.

According to various embodiments, the flexible conductive connector may include a metallic material that is the same as a material of the conductive member.

According to various embodiments, the electronic device may further include a connection piece formed on an inner surface of the conductive member, in which the flexible conductive connector electrically contacts the connection piece.

According to various embodiments, the non-conductive structure may contact the connection piece.

According to various embodiments, the electronic device may further include a via hole penetrating from the first surface to the second surface and a connection pad disposed to correspond to the via hole on the first surface, in which the first antenna pattern is disposed to correspond to the via hole on the second surface.

According to various embodiments, the electronic device may further include a circuit board received in an inner space formed by the sidewall and the non-conductive structure and a flexible conductive connector mounted on the circuit board and connected to the IC chip, in which the flexible conductive connector electrically connects the first antenna pattern to the IC chip.

According to various embodiments, the electronic device may further include a conductor disposed in the via hole to connect the connection pad with the first antenna pattern.

An electronic device according to various embodiments of the present disclosure includes a front cover (e.g., the front cover 102) forming a front surface of the electronic device, a rear cover (e.g., the rear cover 103) forming a rear surface of the electronic device, a sidewall (e.g., the case 101 or the frame 101*b*) at least partially enclosing a space formed between the front cover and the rear cover and at least partially formed of a conductive member, a display (e.g., the display 121) disposed in the space and comprising a screen region exposed through the front cover, a ground plate (e.g., the circuit boards 104 and 106 on which the ground portion G is provided) disposed in the space, at least one wireless communication IC (e.g., the IC chip 141 or the communication module 22), a first antenna pattern (e.g., the first antenna pattern 111*a*) electrically connected with the wireless communication IC, a second antenna pattern (e.g., the second antenna pattern 111*b*) forming electromagnetic coupling with the first antenna pattern and electrically disconnected from the first antenna pattern and the ground plate, and a third antenna pattern (e.g., the conductive member 111*d*) forming electromagnetic coupling with the first antenna pattern and/or the second antenna pattern, electrically connected with the ground plate, and electrically disconnected from the first antenna pattern.

According to various embodiments, when viewed from top of the ground plate, at least a portion of the second antenna pattern may be positioned between the first antenna pattern and the third antenna pattern.

According to various embodiments, the electronic device may further include a fourth antenna pattern (e.g., the parasitic antenna pattern 111*c*) forming electromagnetic coupling with the first antenna pattern and electrically disconnected from the first antenna pattern, the second antenna pattern, the third antenna pattern, and the ground plate.

According to various embodiments, at least a portion of the first antenna pattern may be positioned between the second antenna pattern and the fourth antenna pattern.

According to various embodiments, the first antenna pattern and/or the third antenna pattern may be formed by at least a portion of the sidewall.

According to various embodiments, the wireless communication IC may be configured to provide a radio signal having a frequency in a range selected from 0.7 GHz to 3 GHz.

According to various embodiments, the selected range may include a range from 2.1 GHz to 3 GHz.

As is apparent from the foregoing description, the electronic device according to various embodiments of the present disclosure may have an elegant exterior by using a metallic material for at least a portion of a case (e.g., a case member and a frame) and may use a portion of the case as a radiation conductor through electromagnetic-field coupling. The portion of the case formed of the metallic material is used as a radiation conductor and is fed with electricity through electromagnetic-field coupling, thereby suppressing generation of leakage current on the surface of the electronic device and preventing an electric shock of a user. Moreover, as a conductive pattern (e.g., an antenna pattern) forming electromagnetic-field coupling with a metallic material portion is disposed inside the case, facilitating optimization of the antenna device. For example, a conductive pattern that is not exposed to outside may be more easily changed in shape or size than the metallic material portion of the case, making it easy to optimize the antenna device.

While the present disclosure has been shown and described with reference to various embodiments thereof, it will be understood by those skilled in the art that various changes in form and details may be made therein without departing from the spirit and scope of the present disclosure as defined by the appended claims and their equivalents.

What is claimed is:

1. An electronic device comprising:

a front cover forming a front surface of the electronic device;

a rear cover forming a rear surface of the electronic device;

a sidewall at least partially enclosing a space formed between the front cover and the rear cover and at least partially formed of a conductive member;

a display disposed in the space and comprising a screen region exposed through the front cover;

a non-conductive structure disposed in adjacent to the sidewall or in contact with the sidewall in the space and comprising a first surface facing the front cover and a second surface facing the rear cover;

a first antenna pattern overlapping the non-conductive structure when viewed from top of the non-conductive structure and fed with electricity;

a second antenna pattern overlapping the non-conductive structure when viewed from top of the non-conductive structure and disposed in adjacent to the first antenna pattern to form electromagnetic-field coupling with the first antenna pattern;

a first extension pattern extending from the first antenna pattern and positioned on a portion of a region between the second antenna pattern and the conductive member; and at least one integrated circuit (IC) chip feeding electricity to the first antenna pattern, wherein the first extension pattern forms electromagnetic-field coupling with the second antenna pattern and with the conductive member, respectively, and wherein the conductive member of the sidewall forms electromagnetic-field coupling with the second antenna pattern, such that the first antenna pattern, the second antenna pattern, the first extension pattern, and the conductive member form a portion of an antenna device.

2. The electronic device of claim 1, further comprising:

a parasitic antenna pattern overlapping the non-conductive structure when viewed from top of the non-conductive structure and disposed in adjacent to the first antenna pattern to form electromagnetic-field coupling with the first antenna pattern.

3. The electronic device of claim 2, wherein the first antenna pattern is positioned on a region between the second antenna pattern and the parasitic antenna pattern.

4. The electronic device of claim 1, wherein the second antenna pattern is positioned on a region between the first antenna pattern and the conductive member.

5. The electronic device of claim 1, further comprising:

a slot formed in the first antenna pattern to receive at least a portion of the second antenna pattern.

6. The electronic device of claim 1, wherein electromagnetic-field coupling is formed between the first extension pattern and the conductive member.

7. The electronic device of claim 1, further comprising:

a second extension pattern extending from the second antenna pattern and disposed in parallel with the conductive member.

8. The electronic device of claim 1, further comprising:

a ground portion connected to the conductive member to provide grounding.

9. The electronic device of claim 8, further comprising:

a circuit board received in an inner space formed by the sidewall and the non-conductive structure, wherein the ground portion is provided on the circuit board.

10. The electronic device of claim 9, further comprising:

a flexible conductive connector mounted on the circuit board and connected to the ground portion, wherein the flexible conductive connector connects the conductive member to the ground portion.

11. The electronic device of claim 10, wherein the flexible conductive connector comprises a metallic material that is the same as a material of the conductive member.

12. The electronic device of claim 10, further comprising:

a connection piece formed on an inner surface of the conductive member, wherein the flexible conductive connector electrically contacts the connection piece.

13. The electronic device of claim 12, wherein the non-conductive structure contacts the connection piece.

14. The electronic device of claim 1, further comprising:

a via hole penetrating from the first surface to the second surface; and a connection pad disposed to correspond to the via hole on the first surface, wherein the first antenna pattern is disposed to correspond to the via hole on the second surface.

15. The electronic device of claim 14, further comprising:

a circuit board received in an inner space formed by the sidewall and the non-conductive structure; and a flexible conductive connector mounted on the circuit board and connected to the IC chip, wherein the flexible conductive connector electrically connects the first antenna pattern to the IC chip.

16. The electronic device of claim 14, further comprising:

a conductor disposed in the via hole to connect the connection pad with the first antenna pattern.

17. An electronic device comprising:

a front cover forming a front surface of the electronic device;

a rear cover forming a rear surface of the electronic device;

a sidewall at least partially enclosing a space formed between the front cover and the rear cover and at least partially formed of a conductive member;

a display disposed in the space and comprising a screen region exposed through the front cover;

a ground plate disposed in the space;

at least one wireless communication integrated circuit (IC);

a first antenna pattern electrically connected with the wireless communication IC;

a second antenna pattern forming electromagnetic coupling with the first antenna pattern and disconnected from the first antenna pattern and the ground plate;

a third antenna pattern forming electromagnetic coupling with at least one of the first antenna pattern or the second antenna pattern, electrically connected with the ground plate, and disconnected from the first antenna pattern; and a first extension pattern extending from the first antenna pattern and positioned on a portion of a region between the second antenna pattern and the third antenna pattern, wherein the first extension pattern forms electromagnetic-field coupling with the second antenna pattern and with the third antenna pattern.

18. The electronic device of claim 17, wherein when viewed from top of the ground plate, at least a portion of the second antenna pattern is positioned between the first antenna pattern and the third antenna pattern.

19. The electronic device of claim 17, further comprising:

a fourth antenna pattern forming electromagnetic coupling with the first antenna pattern and electrically disconnected from the first antenna pattern, the second antenna pattern, the third antenna pattern, and the ground plate.

20. The electronic device of claim 19, wherein at least a portion of the first antenna pattern is positioned between the second antenna pattern and the fourth antenna pattern.

21. The electronic device of claim 17, wherein at least one of the first antenna pattern or the third antenna pattern is formed by at least a portion of the sidewall.

22. The electronic device of claim 17, wherein the wireless communication IC is configured to provide a radio signal having a frequency in a range selected from 0.7 GHz to 3 GHz.

23. The electronic device of claim 22, wherein the selected range comprises a range from 2.1 GHz to 3 GHz.

* * * * *